US011414912B2

(12) United States Patent
Kojima

(10) Patent No.: US 11,414,912 B2
(45) Date of Patent: Aug. 16, 2022

(54) OPENING AND CLOSING BODY CONTROL DEVICE AND PROGRAM

(71) Applicant: DENSO CORPORATION, Kariya (JP)

(72) Inventor: Hideo Kojima, Kariya (JP)

(73) Assignee: DENSO CORPORATION, Kariya (JP)

( * ) Notice: Subject to any disclaimer, the term of this patent is extended or adjusted under 35 U.S.C. 154(b) by 325 days.

(21) Appl. No.: 16/865,630

(22) Filed: May 4, 2020

(65) Prior Publication Data

US 2020/0355012 A1 Nov. 12, 2020

(30) Foreign Application Priority Data

May 10, 2019 (JP) ..... JP2019-089579

(51) Int. Cl.
*E05F 15/695* (2015.01)
*E05F 15/659* (2015.01)

(52) U.S. Cl.
CPC ..... *E05F 15/695* (2015.01); *E05F 15/659* (2015.01)

(58) Field of Classification Search
CPC .. E05F 15/695; E05F 15/659; E05Y 2400/32; E05Y 2400/36
USPC ..... 318/3, 34; 701/49
See application file for complete search history.

(56) References Cited

U.S. PATENT DOCUMENTS 8,134,312 B2 * 3/2012 Kigoshi ..... E05F 15/41 318/483

FOREIGN PATENT DOCUMENTS

JP 2018-012490 A 1/2018

* cited by examiner

*Primary Examiner* — David Luo
(74) *Attorney, Agent, or Firm* — Oliff PLC

(57) ABSTRACT

An opening and closing body control device includes: a target speed recalculation unit that, when the first opening and closing body and the second opening and closing body are moving, recalculates the respective target speeds of each of the first opening and closing body and the second opening and closing body for reaching the target open amounts at the same time; and a second synchronous control unit that, in a case in which a speed of at least one of the first opening and closing body or the second opening and closing body is different from the target speed calculated by the target speed calculation unit, controls the first motor drive unit and the second motor drive unit so that the first opening and closing body and the second opening and closing body move at the respective target speeds recalculated by the target speed recalculation unit.

5 Claims, 11 Drawing Sheets

OPENING AND CLOSING BODY CONTROL DEVICE AND PROGRAM

CROSS-REFERENCE TO RELATED APPLICATION

This application is based upon and claims the benefit of priority of the prior Japanese Patent Application No. 2019-089579, filed on May 10, 2019, the entire contents of which are incorporated herein by reference.

BACKGROUND

Technical Field

The present invention relates to an opening and closing body control device and program.

Related Art

As an opening and closing body control device, the following device is well known (e.g., Japanese Patent Application Laid-open (JP-A) No. 2018-12490). That is, the well-known opening and closing body control device is equipped with a first motor drive unit that causes a first opening and closing body to move in opening and closing directions, a second motor drive unit that causes a second opening and closing body to move in opening and closing directions, and a control unit that controls the first motor drive unit and the second motor drive unit.

In this opening and closing body control device, in a case where there is a time difference between when the first opening and closing body starts moving and when the second opening and closing body starts moving, the speed of at least one of the first opening and closing body and the second opening and closing body is adjusted so that the first opening and closing body and the second opening and closing body reach target open amounts (target positions) at the same time.

However, in the above opening and closing body control device, consideration is not given to a change in speed as the first opening and closing body and the second opening and closing body are moving. Consequently, in a case where the speed of at least one of the first opening and closing body and the second opening and closing body has changed due to the effect of a disturbance, for example, as the first opening and closing body and the second opening and closing body are moving, there is the concern that the first opening and closing body and the second opening and closing body will not be able to reach the target open amounts at the same time.

SUMMARY OF THE INVENTION

The present invention has been made in view of the above problem, and it is an object thereof to provide an opening and closing body control device and program which, even in a case where the speed of at least one of a first opening and closing body and a second opening and closing body has changed as the first opening and closing body and the second opening and closing body are moving, can make the first opening and closing body and the second opening and closing body reach their target open amounts at the same time.

An opening and closing body control device pertaining to a first aspect includes: a first motor drive unit that causes a first opening and closing body to move in opening and closing directions; a second motor drive unit that causes a second opening and closing body to move in opening and closing directions; a target speed calculation unit that, in a case in which an activation command that causes the first opening and closing body and the second opening and closing body to reach respective target open amounts at the same time has been received, calculates respective target speeds of each of the first opening and closing body and the second opening and closing body for reaching the target open amounts at the same time; a first synchronous control unit that controls the first motor drive unit and the second motor drive unit so that the first opening and closing body and the second opening and closing body move at the respective target speeds; a target speed recalculation unit that, when the first opening and closing body and the second opening and closing body are moving, recalculates the respective target speeds of each of the first opening and closing body and the second opening and closing body for reaching the target open amounts at the same time; and a second synchronous control unit that, in a case in which a speed of at least one of the first opening and closing body or the second opening and closing body is different from the target speed calculated by the target speed calculation unit, controls the first motor drive unit and the second motor drive unit so that the first opening and closing body and the second opening and closing body move at the respective target speeds recalculated by the target speed recalculation unit.

According to the opening and closing body control device pertaining to the first aspect, in a case where a move command that causes the first opening and closing body and the second opening and closing body to reach their target open amounts at the same time has been received, the target speeds of each of the first opening and closing body and the second opening and closing body for reaching the target open amounts at the same time are calculated by the target speed calculation unit. Additionally, the first motor drive unit and the second motor drive unit are controlled by the first synchronous control unit so that the first opening and closing body and the second opening and closing body move at the target speeds.

Here, there are cases where the speed of at least one of the first opening and closing body and the second opening and closing body changes due to the effect of a disturbance, for example, as the first opening and closing body and the second opening and closing body are moving.

However, according to the opening and closing body control device pertaining to the first aspect, when the first opening and closing body and the second opening and closing body are moving, the target speeds of each of the first opening and closing body and the second opening and closing body for reaching the target open amounts at the same time are recalculated by the target speed recalculation unit. Additionally, in a case where the speed of at least one of the first opening and closing body and the second opening and closing body is different from the target speed calculated by the target speed calculation unit, the first motor drive unit and the second motor drive unit are controlled by the second synchronous control unit so that the first opening and closing body and the second opening and closing body move at the target speeds recalculated by the target speed recalculation unit.

Consequently, even in a case where the speed of at least one of the first opening and closing body and the second opening and closing body has changed due to the effect of a disturbance, for example, as the first opening and closing body and the second opening and closing body are moving, the first opening and closing body and the second opening and closing body move at the recalculated target speeds so that the first opening and closing body and the second opening and closing body reach the target open amounts at the same time. Because of this, the first opening and closing body and the second opening and closing body can be made to reach their target open amounts at the same time.

An opening and closing body control device pertaining to a second aspect is the opening and closing body control device pertaining to the first aspect, wherein the target speed recalculation unit, in a case in which the second opening and closing body is moving at the respective target speed calculated by the target speed calculation unit and the speed of the first opening and closing body is lower than the respective target speed calculated by the target speed calculation unit, recalculates a target speed that is lower than the respective target speed calculated by the target speed calculation unit with regard to the second opening and closing body so that the second opening and closing body reaches its target open amount at the same time that the first opening and closing body reaches its target open amount.

According to the opening and closing body control device pertaining to the second aspect, in a case where the second opening and closing body is moving at the target speed calculated by the target speed calculation unit and the speed of the first opening and closing body is lower than the target speed calculated by the target speed calculation unit, a target speed that is lower than the target speed calculated by the target speed calculation unit in regard to the second opening and closing body is recalculated by the target speed recalculation unit so that the second opening and closing body reaches its target open amount at the same time that the first opening and closing body reaches its target open amount. Consequently, even in a case where the speed of the first opening and closing body has fallen due to the effect of a disturbance, the speed of the second opening and closing body is lowered to conform to the first opening and closing body, so a situation where the second opening and closing body reaches the target open amount before the first opening and closing body can be avoided, so that the first opening and closing body and the second opening and closing body can be made to reach their target open amounts at the same time.

An opening and closing body control device pertaining to a third aspect is the opening and closing body control device pertaining to the first aspect, wherein the target speed recalculation unit, in a case in which the second opening and closing body is moving at the respective target speed calculated by the target speed calculation unit and the speed of the first opening and closing body is higher than the respective target speed calculated by the target speed calculation unit, recalculates a target speed that is lower than the respective target speed calculated by the target speed calculation unit with regard to the first opening and closing body so that the first opening and closing body reaches its target open amount at the same time that the second opening and closing body reaches its target open amount.

According to the opening and closing body control device pertaining to the third aspect, in a case where the second opening and closing body is moving at the target speed calculated by the target speed calculation unit and the speed of the first opening and closing body is higher than the target speed calculated by the target speed calculation unit, a target speed that is lower than the target speed calculated by the target speed calculation unit in regard to the first opening and closing body is recalculated by the target speed recalculation unit so that the first opening and closing body reaches its target open amount at the same time that the second opening and closing body reaches its target open amount. Consequently, even in a case where the speed of the first opening and closing body has risen due to the effect of a disturbance, the speed of the first opening and closing body is lowered to conform to the second opening and closing body, so a situation where the first opening and closing body reaches the target open amount before the second opening and closing body can be avoided, so that the first opening and closing body and the second opening and closing body can be made to reach their target open amounts at the same time.

An opening and closing body control device pertaining to a fourth aspect is the opening and closing body control device pertaining to the first aspect, wherein the target speed recalculation unit comprises: a remaining distance calculation unit that, in a case in which the second opening and closing body is moving at the respective target speed calculated by the target speed calculation unit and the speed of the first opening and closing body is lower than the respective target speed calculated by the target speed calculation unit, calculates a remaining distance until the first opening and closing body reaches its target open amount, a lag distance calculation unit that calculates a lag distance that is a difference between an open amount of the first opening and closing body in a case in which it is presumed that that the first opening and closing body had been moving at the respective target speed calculated by the target speed calculation unit and a current open amount of the first opening and closing body, a comparative speed calculation unit that calculates a comparative speed obtained by dividing the remaining distance by a time until the second opening and closing body reaches its target open amount, a distance determination unit that determines whether or not the remaining distance is longer than the lag distance, a speed determination unit which, in a case in which it has been determined by the distance determination unit that the remaining distance is longer than the lag distance, determines whether or not an upper limit speed that has been set beforehand with regard to the first opening and closing body is higher than the comparative speed, and a first target speed recalculation unit that, in a case in which it has been determined by the speed determination unit that the upper limit speed is higher than the comparative speed, recalculates a target speed that is higher than the respective target speed calculated by the target speed calculation unit with regard to the first opening and closing body.

According to the opening and closing body control device pertaining to the fourth aspect, in a case where the remaining distance until reaching the target open amount of the first opening and closing body is longer than the lag distance of the first opening and closing body and the upper limit speed of the first opening and closing body is higher than the comparative speed, a target speed that is higher than the target speed calculated by the target speed calculation unit in regard to the first opening and closing body is recalculated by the first target speed recalculation unit. Consequently, even in a case where the speed of the first opening and closing body has fallen due to the effect of a disturbance, the speed of the first opening and closing body is raised to conform to the second opening and closing body, so a situation where the second opening and closing body reaches the target open amount before the first opening and closing body can be avoided, so that the first opening and closing body and the second opening and closing body can be made to reach their target open amounts at the same time.

An opening and closing body control device pertaining to a fifth aspect is the opening and closing body control device pertaining to the fourth aspect, wherein the target speed recalculation unit further comprises a second target speed recalculation unit which, in a case in which it has been determined by the distance determination unit that the remaining distance is equal to or less than the lag distance or in a case in which it has been determined by the speed determination unit that the upper limit speed is equal to or less than the comparative speed, recalculates a target speed that is lower than the target speed calculated by the target speed calculation unit with regard to the second opening and closing body.

According to the opening and closing body control device pertaining to the fifth aspect, in a case where the remaining distance until reaching the target open amount of the first opening and closing body is equal to or less than the lag distance of the first opening and closing body or a case where the upper limit speed of the first opening and closing body is equal to or less than the comparative speed, a target speed that is lower than the target speed calculated by the target speed calculation unit in regard to the second opening and closing body is recalculated by the second target speed recalculation unit. Consequently, in a case where the second opening and closing body will end up reaching the target open amount first even if the speed of the first opening and closing body is raised, the speed of the second opening and closing body is lowered to conform to the first opening and closing body, so a situation where the second opening and closing body reaches the target open amount before the first opening and closing body can be avoided, so that the first opening and closing body and the second opening and closing body can be made to reach their target open amounts at the same time.

DETAILED DESCRIPTION OF THE INVENTION

First Embodiment

First, a first embodiment of the invention will be described.

Figure 1:
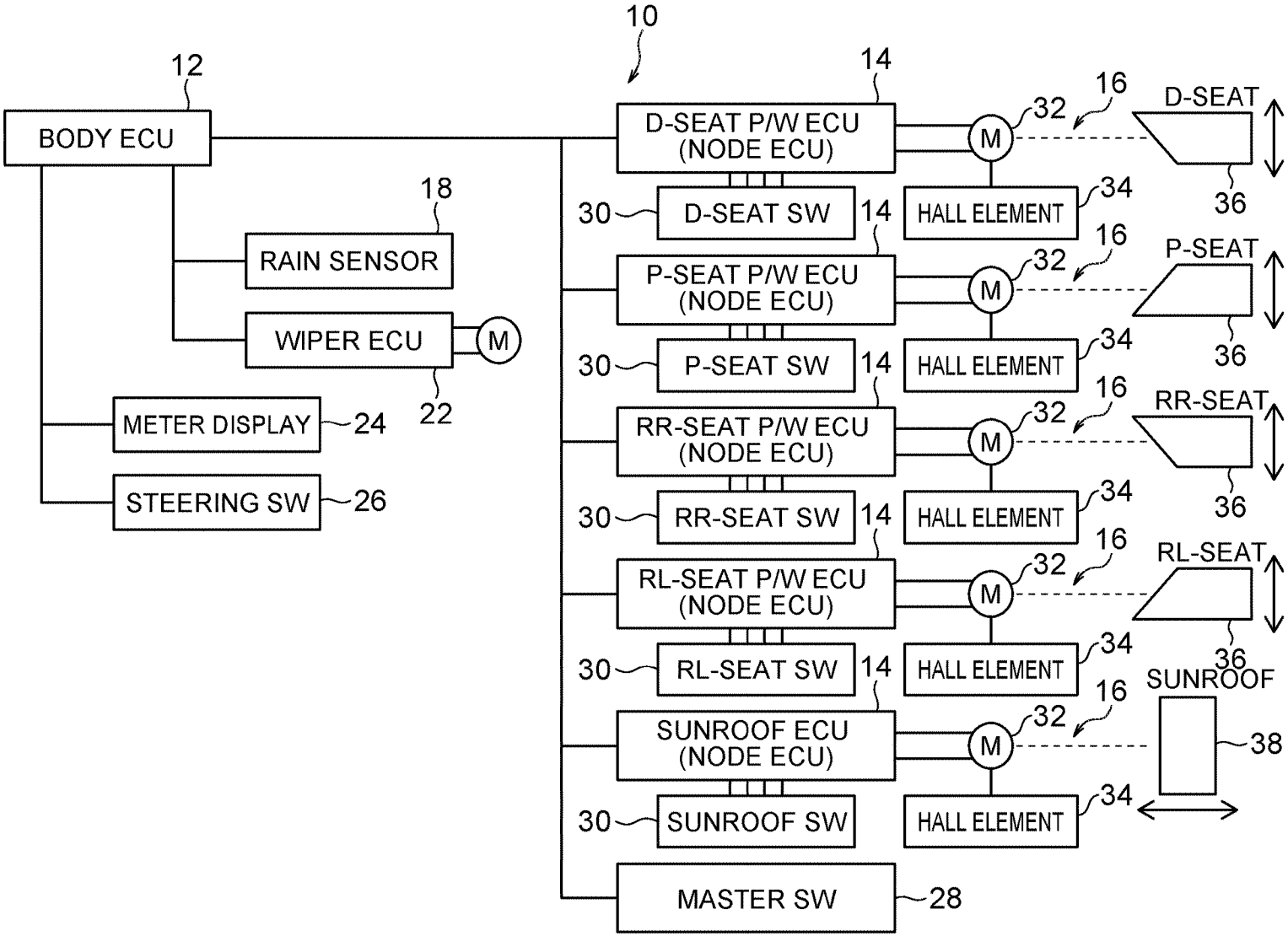
FIG. 1 is a block diagram of an opening and closing body control device pertaining to a first embodiment.

In FIG. 1, an opening and closing body control device 10 pertaining to the first embodiment is shown in a block diagram. In the first embodiment, as an example, an example where the opening and closing body control device 10 is applied to a vehicle such as a passenger car will be described.

The opening and closing body control device 10 pertaining to the first embodiment is equipped with a body electronic control unit (ECU) 12, plural node ECUs 14, and plural motor drive units 16. The body ECU 12 and the plural node ECUs 14 are an example of a "control unit."

Connected to the body ECU 12 (central ECU) are the plural node ECUs 14. Also connected to the body ECU 12 are a rain sensor 18, a wiper ECU 22, a meter 24, a steering switch 26, and a master switch 28.

The plural node ECUs 14 include a D-seat (front right driver's seat) power window ECU, a P-seat (front left passenger seat) power window ECU, a RR-seat (rear right seat) power window ECU, a RL-seat (rear left seat) power window ECU, and a sunroof ECU.

A D-seat switch 30 is connected to the D-seat node ECU 14, and a P-seat switch 30 is connected to the P-seat node ECU 14. Furthermore, a RR-seat switch 30 is connected to the RR-seat node ECU 14, a RL-seat switch 30 is connected to the RL-seat node ECU 14, and a sunroof switch 30 is connected to the sunroof node ECU 14.

The plural motor drive units 16 are connected to the plural node ECUs 14. Each motor drive unit 16 has a motor 32 and a Hall element 34. The Hall element 34 is a configuration that outputs signals according to the angle of rotation of the motor 32.

The motor 32 of the D-seat motor drive unit 16 is connected to a D-seat window glass 36, and the motor 32 of the P-seat motor drive unit 16 is connected to a P-seat window glass 36. Furthermore, the motor 32 of the RR-seat motor drive unit 16 is connected to a RR-seat window glass 36, the motor 32 of the RL-seat motor drive unit 16 is connected to a RL-seat window glass 36, and the motor 32 of the sunroof motor drive unit 16 is connected to a sunroof 38.

Each window glass 36 is supported in a door of the vehicle so as to be movable (raiseable and lowerable) in upward and downward directions as opening and closing directions, and the sunroof 38 is supported in a roof of the vehicle so as to be movable (slidable) in forward and rearward directions as opening and closing directions.

The plural D-seat, P-seat, RR-seat, and RL-seat motor drive units 16 are configurations that cause the D-seat, P-seat, RR-seat, and RL-seat window glasses 36, respectively, to move in opening and closing directions, and the sunroof motor drive unit 16 is a configuration that causes the sunroof 38 to move in opening and closing directions.

Figure 2:
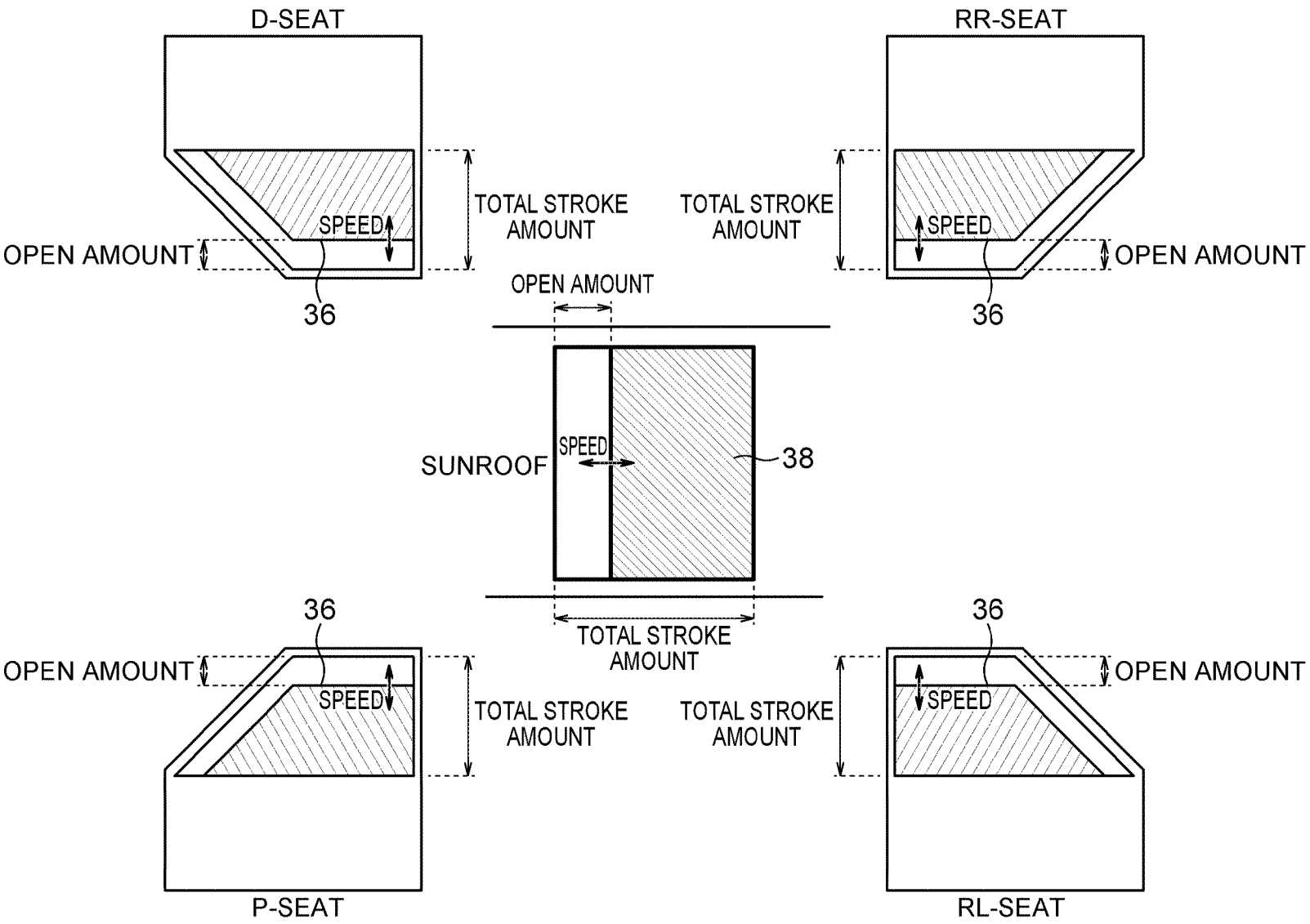
FIG. 2 is an unfolded view of D-seat, P-seat, RR-seat, and RL-seat window glasses and a sunroof of FIG. 1.

In FIG. 2, the D-seat, P-seat, RR-seat, and RL-seat window glasses 36 and the sunroof 38 are shown in an unfolded view. The open amounts of the window glasses 36 correspond to moving distances of upper ends of the window glasses 36 from a state in which the window glasses 36 are completely closed, and the total stroke amounts of the window glasses 36 correspond to moving distances of the upper ends of the window glasses 36 from a state in which the window glasses 36 are completely closed to a state in which they are completely open.

The open amount of the sunroof 38 corresponds to a moving distance of a front end of the sunroof 38 from a state in which the sunroof 38 is completely closed, and the total stroke amount of the sunroof 38 corresponds to a moving distance of the front end of the sunroof 38 from a state in which the sunroof 38 is completely closed to a state in which it is completely open. As an example, the D-seat and P-seat window glasses 36, the RR-seat and RL-seat window glasses 36, and the sunroof 38 have mutually different total stroke amounts.

Figure 3:
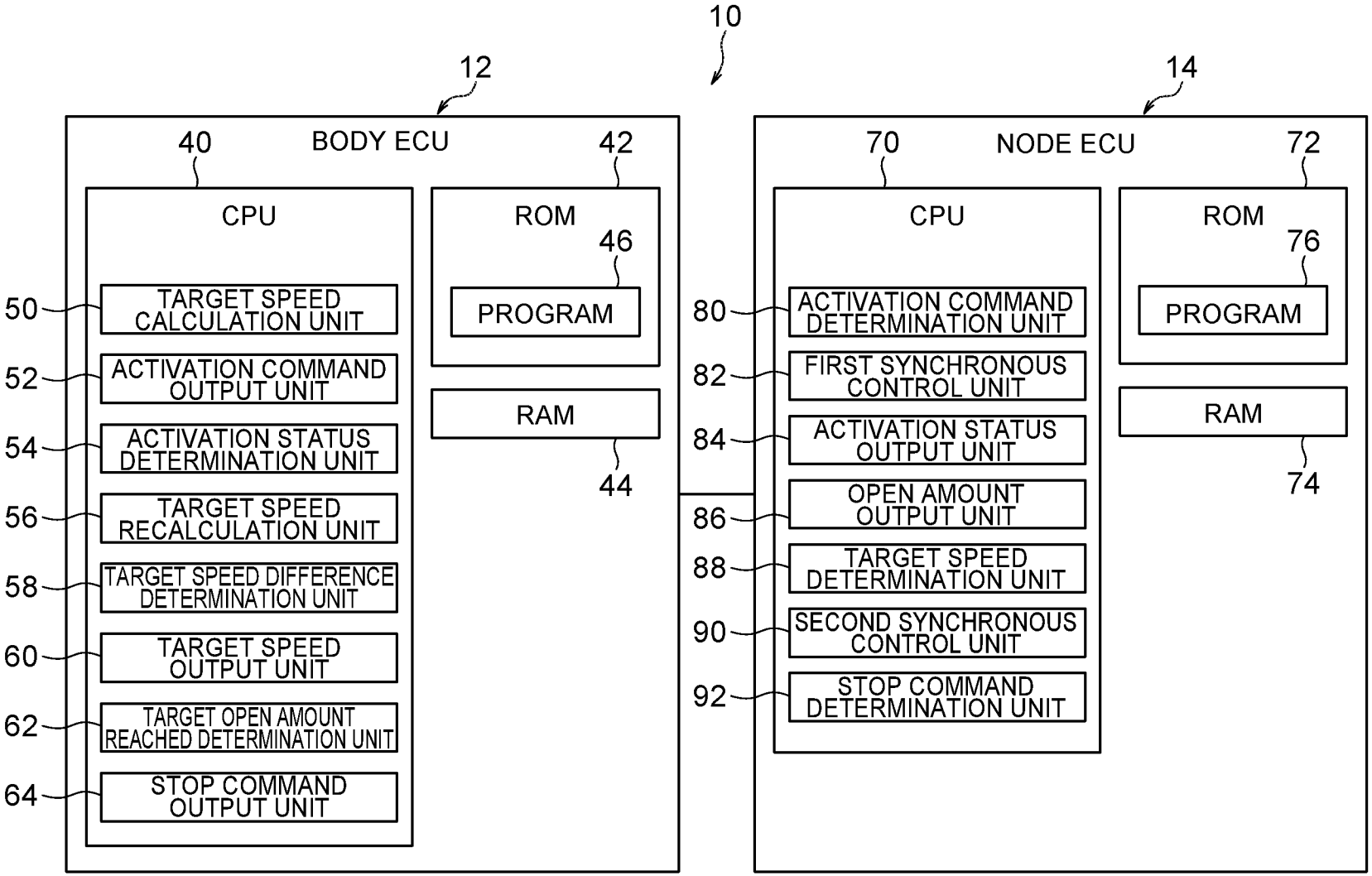
FIG. 3 is a block diagram of a body ECU and node ECUs of FIG. 1.

In FIG. 3, the body ECU 12 and the node ECUs 14 are shown in a block diagram. The body ECU 12 has a central processing unit (CPU) 40, a read-only memory (ROM) 42, and a random-access memory (RAM) 44. Stored in the ROM 42 is a program 46. The CPU 40 is a computer, reads the program 46 stored in the ROM 42, transfers the program 46 to the RAM 44, and executes it.

The body ECU 12 has, as functional units that function in a case where an activation command has been received, a target speed calculation unit 50, an activation command output unit 52, an activation status determination unit 54, a target speed recalculation unit 56, a target speed difference determination unit 58, a target speed output unit 60, a target open amount reached determination unit 62, and a stop command output unit 64. These functional units such as the target speed calculation unit 50 are realized by the CPU 40 executing the program 46.

Each node ECU 14 has a CPU 70, a ROM 72, and a RAM 74. Stored in the ROM 72 is a program 76. The CPU 70 is a computer, reads the program 76 stored in the ROM 72, transfers the program 76 to the RAM 74, and executes it.

Each node ECU 14 has, as functional units that function in a case where an activation command has been received, an activation command determination unit 80, a first synchronous control unit 82, an activation status output unit 84, an open amount output unit 86, a target speed determination unit 88, a second synchronous control unit 90, and a stop command determination unit 92. These functional units such as the activation command determination unit 80 are realized by the CPU 70 executing the program 76.

Figure 4:
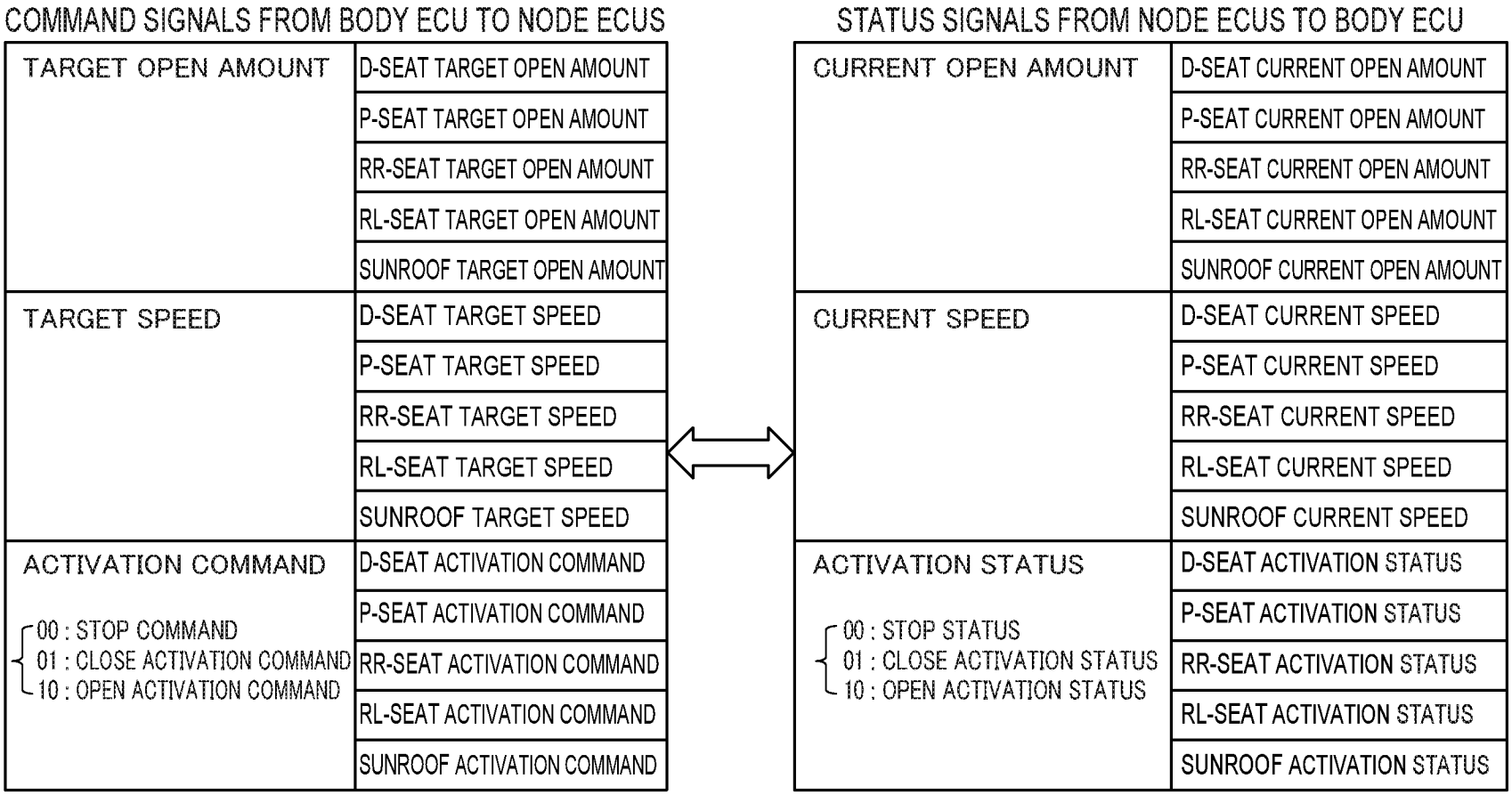
FIG. 4 is a diagram showing content of signals transmitted and received between the body ECU and the node ECUs of FIG. 1.

In FIG. 4, the content of signals transmitted and received between the body ECU 12 and the node ECUs 14 is shown. From the body ECU 12 to the node ECUs 14, target open amounts, target speeds, and activation commands are output as command signals in regard to each of the D-seat, P-seat, RR-seat, and RL-seat window glasses 36 and the sunroof 38.

From the node ECUs 14 to the body ECU 12, current open amounts, current speeds, and activation statuses are output as status signals in regard to each of the D-seat, P-seat, RR-seat, and RL-seat window glasses 36 and the sunroof 38.

It will be noted that the target open amounts output from the body ECU 12 to the node ECUs 14 and the current speeds output from the node ECUs 14 to the body ECU 12 are utilized by functional units other than the above-described functional units.

Next, example operations of the opening and closing body control device 10 pertaining to the first embodiment will be described.

First Example Operation

In a first example operation, the plural opening and closing bodies serving as targets are the D-seat and RR-seat window glasses 36. This first example operation is an example in a case where the speed of the D-seat window glass 36 falls due to the effect of a disturbance as the D-seat and RR-seat window glasses 36 are being moved at the same time to a completely open state from a state in which the D-seat, P-seat, RR-seat, and RL-seat window glasses 36 and the sunroof 38 are completely closed.

In this first example operation, the D-seat window glass 36 corresponds to a "first opening and closing body" and the RR-seat window glass 36 corresponds to a "second opening and closing body." Furthermore, in the first example operation, the D-seat motor drive unit 16 corresponds to a "first motor drive unit" and the RR-seat motor drive unit 16 corresponds to a "second motor drive unit."

Figure 6:
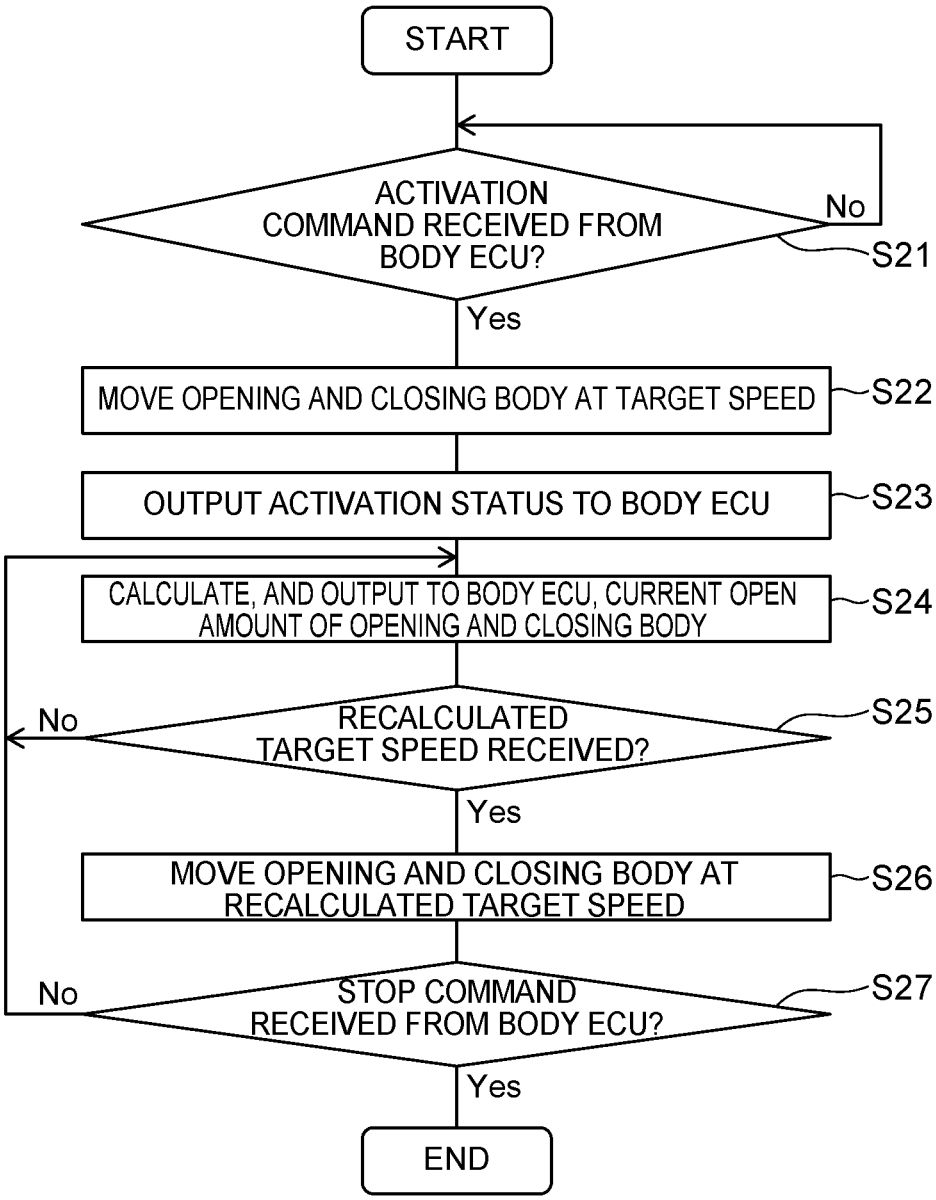
FIG. 6 is a flowchart showing a flow of processes performed by the node ECUs of FIG. 1.
Figure 7:
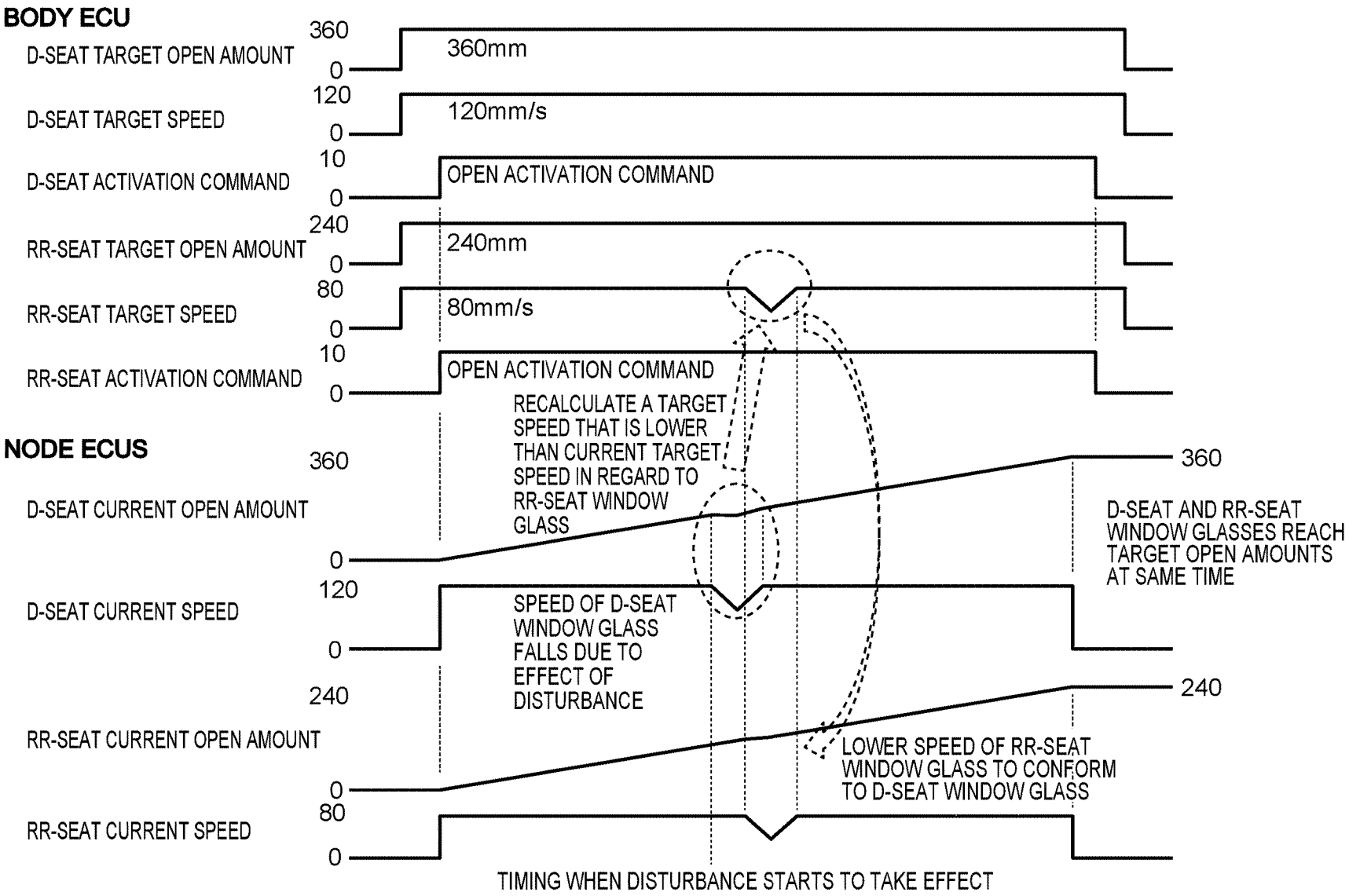
FIG. 7 is a timing chart showing an example of signals transmitted and received between the body ECU and the node ECUs of FIG. 1.

Regarding the flow of processes performed by the body ECU 12, reference will be made to FIG. 5, and regarding the flow of processes performed by the D-seat and RR-seat node ECUs 14, reference will be made to FIG. 6. In FIG. 7, a timing chart of signals transmitted and received between the body ECU 12 and the D-seat and RR-seat node ECUs 14 in the first example operation is shown.

(Step S1: Target Speed Calculation Step)

The body ECU 12 executes step S1 in a case where it has received, from the master switch 28 for example, an activation command that causes the D-seat and RR-seat window glasses 36 to reach their target open amounts at the same time. In step S1, the CPU 40 (the target speed calculation unit 50) of the body ECU 12 calculates target speeds of each of the D-seat and RR-seat window glasses 36 for reaching the target open amounts at the same time. Hereafter, there are cases where the target speeds calculated by step S1 are called "initial target speeds."

In step S1, regarding the D-seat window glass 36, for example, a target speed of 120 mm/s is calculated with respect to a target open amount of 360 mm, and regarding the RR-seat window glass 36, for example, a target speed of 80 mm/s is calculated with respect to a target open amount of 240 mm.

(Step S2: Activation Command Output Step)

In step S2, the CPU 40 (the activation command output unit 52) of the body ECU 12 outputs the target speed of the D-seat window glass 36 to the D-seat ECU 14 and outputs the target speed of the RR-seat window glass 36 to the RR-seat node ECU 14. Next, the CPU 40 (the activation command output unit 52) of the body ECU 12 outputs an open activation command "10" as an activation command to the D-seat and RR-seat node ECUs 14.

(Step S21: Activation Command Determination Step)

In step S21, the CPUs 70 (the activation command determination units 80) of the D-seat and RR-seat node ECUs 14 determine whether or not they have received an activation command from the body ECU 12. The CPUs 70 (the activation command determination units 80) move to step S22 when they determine that they have received an activation command from the body ECU 12.

(Step S22: First Synchronous Control Step)

In step S22, the CPUs 70 (the first synchronous control units 82) of the D-seat and RR-seat node ECUs 14 control the D-seat and RR-seat motor drive units 16 so that the D-seat and RR-seat window glasses 36 move (go down) at the target speeds output from the body ECU 12. Because of this, the D-seat and RR-seat window glasses 36 start moving at the target speeds.

(Step S23: Activation Status Output Step)

In step S23, the CPUs 70 (the activation status output units 84) of the D-seat and RR-seat node ECUs 14 output open activation statuses "10" as activation statuses to the body ECU 12.

(Step S24: Open Amount Output Step)

In step S24, the CPUs 70 (the open amount output units 86) of the D-seat and RR-seat node ECUs 14 calculate the current open amounts of the D-seat and RR-seat window glasses 36 on the basis of the output of the Hall elements 34 and output the current open amounts they have calculated to the body ECU 12.

(Step S3: Activation Status Determination Step)

In step S3, the CPU 40 (the activation status determination unit 54) of the body ECU 12 determines the activation statuses of the D-seat and RR-seat motor drive units 16 on the basis of the activation statuses output from the D-seat and RR-seat node ECUs 14.

In a case where open activation statuses "10" are being output as the activation statuses from the CPUs 70 of the D-seat and RR-seat node ECUs 14, the CPU 40 (the activation status determination unit 54) of the body ECU 12 determines that the D-seat and RR-seat motor drive units 16 are activated and moves to step S4.

(Step S4: Target Speed Recalculation Step)

In step S4, the CPU 40 (the target speed recalculation unit 56) of the body ECU 12 recalculates the target speeds of each of the D-seat and RR-seat window glasses 36 for reaching the target open amounts at the same time on the basis of the current open amounts of each of the D-seat and RR-seat window glasses 36.

Here, as shown in FIG. 7, in a state before a disturbance affects the D-seat window glass 36, the D-seat and RR-seat window glasses 36 are moving at the initial target speeds, so target speeds that are the same as the initial target speeds are recalculated in regard to each of the D-seat and RR-seat window glasses 36.

However, as shown in FIG. 7, in a state in which the speed of the D-seat window glass 36 has becomes lower than the initial target speed due to the effect of a disturbance, a target speed that is the same as the initial target speed is recalculated in regard to the D-seat window glass 36, but a target speed that is lower than the initial target speed is recalculated in regard to the RR-seat window glass 36 so that the RR-seat window glass 36 reaches its target open amount at the same time that the D-seat window glass 36 reaches its target open amount.

(Step S5: Target Speed Difference Determination Step)

In step S5, the CPU 40 (the target speed difference determination unit 58) of the body ECU 12 determines whether or not there is a difference between the recalculated target speeds and the initial target speeds in regard to each of the D-seat and RR-seat window glasses 36.

Here, as shown in FIG. 7, in a state before a disturbance affects the D-seat window glass 36, there are no differences between the recalculated target speeds and the initial target speeds in regard to each of the D-seat and RR-seat window glasses 36, so the CPU 40 (the target speed difference determination unit 58) of the body ECU 12 moves to step S7.

However, as shown in FIG. 7, in a state in which the speed of the D-seat window glass 36 has become lower than the initial target speed due to the effect of a disturbance, the CPU 40 (the target speed difference determination unit 58) of the body ECU 12 moves to step S6 because there is a difference between the recalculated target speed and the initial target speed in regard to the RR-seat window glass 36.

(Step S6: Target Speed Output Step)

In step S6, the CPU 40 (the target speed output unit 60) of the body ECU 12 outputs the recalculated target speeds to the D-seat and RR-seat node ECUs 14.

(Step S25: Target Speed Determination Step)

In step S25, the CPUs 70 (the target speed determination units 88) of the D-seat and RR-seat node ECUs 14 determine whether or not recalculated target speeds have been output from the body ECU 12.

Here, the CPUs 70 (the target speed determination units 88) of the D-seat and RR-seat node ECUs 14 return to step S24 in a case where they have determined that recalculated target speeds have not been output from the body ECU 12. However, the CPUs 70 (the target speed determination units 88) of the D-seat and RR-seat node ECUs 14 move to step S26 in a case where they have determined that recalculated target speeds have been output from the body ECU 12.

(Step S26: Second Synchronous Control Step)

In step S26, the CPUs 70 (the second synchronous control units 90) of the D-seat and RR-seat node ECUs 14 control the motor drive units 16 so that the D-seat and RR-seat window glasses 36 move at the recalculated target speeds.

Because of this, each of the D-seat and RR-seat window glasses 36 move at the recalculated target speeds. Namely, the D-seat window glass 36 moves at a target speed that is the same as the initial target speed, but the RR-seat window glass 36 moves at a target speed that is lower than the initial target speed.

Then, the D-seat and RR-seat node ECUs 14 return to step S24 in a case where they have determined that they have not received a stop command from the body ECU 12 in step S27. In step S24, as mentioned above, the CPUs 70 (the open amount output units 86) of the D-seat and RR-seat node ECUs 14 calculate the current open amounts of the D-seat and RR-seat window glasses 36 on the basis of the output of the Hall elements 34 and output the current open amounts they have calculated to the body ECU 12.

(Step S7: Target Open Amount Reached Determination Step)

In step S7, the CPU 40 (the target open amount reached determination unit 62) of the body ECU 12 determines whether or not each of the D-seat and RR-seat window glasses 36 have reached the target open amounts on the basis of the open amounts output from the D-seat and RR-seat node ECUs 14.

Here, the CPU 40 (the target open amount reached determination unit 62) of the body ECU 12 returns to step S4 in a case where it has determined that each of the D-seat and RR-seat window glasses 36 have not reached the target open amounts. Additionally, the CPU 40 of the body ECU 12 repeatedly executes step S4 to step S7 until it determines that each of the D-seat and RR-seat window glasses 36 have reached the target open amounts.

Because step S4 to step S7 are repeatedly executed, the D-seat and RR-seat window glasses 36 move at the initial target speeds when the effect of the disturbance finally goes away. Then, when the D-seat and RR-seat window glasses 36 reach their target open amounts (completely open positions) at the same time, the CPU 40 (the target open amount reached determination unit 62) of the body ECU 12 determines that each of the D-seat and RR-seat window glasses 36 have reached the target open amounts and moves to step S8.

(Step S8: Stop Command Output Step)

In step S8, the CPU 40 (the stop command output unit 64) of the body ECU 12 outputs a stop command "00" to the D-seat and RR-seat node ECUs 14.

(Step S27: Stop Command Determination Step)

In step S27, the CPUs 70 (the stop command determination units 92) of the D-seat and RR-seat node ECUs 14 determine whether or not they have received a stop command from the body ECU 12. The CPUs 70 (the stop command determination units 92) stop the motor drive units 16 and end the series of processes when they determine that they have received a stop command from the body ECU 12.

In this way, according to the first example operation, when the D-seat and RR-seat window glasses 36 are moving, the target speeds of each of the D-seat and RR-seat window glasses 36 for reaching the target open amounts at the same time are recalculated on the basis of the current open amounts of each of the D-seat and RR-seat window glasses 36. Furthermore, it is determined whether or not there is a difference between the recalculated target speeds and the initial target speeds in regard to each of the D-seat and RR-seat window glasses 36.

Then, in a case where it has been determined that there is a difference between the recalculated target speeds and the initial target speeds in regard to each of the D-seat and RR-seat window glasses 36, the D-seat and RR-seat motor drive units 16 are controlled so that the D-seat and RR-seat window glasses 36 move at the recalculated target speeds.

Consequently, even in a case where the speed of the D-seat window glass 36 has fallen due to the effect of a disturbance, for example, as the D-seat and RR-seat window glasses 36 are moving, the D-seat and RR-seat window glasses 36 move at the recalculated target speeds so that the D-seat and RR-seat window glasses 36 reach the target open amounts at the same time. Because of this, the D-seat and RR-seat window glasses 36 can be made to reach their target open amounts at the same time.

Furthermore, in a case where the speed of the D-seat window glass 36 is lower than the initial target speed due to the effect of a disturbance, a target speed that is lower than the initial target speed is recalculated in regard to the RR-window glass 36 so that the RR-seat window glass 36 reaches its target open amount at the same time that the D-seat window glass 36 reaches its target open amount.

Consequently, even in a case where the speed of the D-seat window glass 36 has fallen due to the effect of a disturbance, the speed of the RR-seat window glass 36 is lowered to conform to the D-seat window glass 36, so a situation where the RR-seat window glass 36 reaches the target open amount before the D-seat window glass 36 can be avoided, so that the D-seat and RR-seat window glasses 36 can be made to reach their target open amounts at the same time.

It will be noted that the same processes as those of the first example operation may also be executed in a case where, as two opening and closing bodies that are a combination other than the D-seat and RR-seat window glasses 36 out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are completely closed, the speed of at least one of the two opening and closing bodies falls due to the effect of a disturbance.

Furthermore, the same processes as those of the first example operation may also be executed in a case where, as two opening and closing bodies out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are in intermediate positions between completely closed positions and completely open positions, the speed of at least one of the two opening and closing bodies falls due to the effect of a disturbance.

Furthermore, the same processes as those of the first example operation may also be executed in a case where, as two opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are completely open, the speed of at least one of the two opening and closing bodies falls due to the effect of a disturbance.

Furthermore, the same processes as those of the first example operation may also be executed in a case where, as two opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are in intermediate positions between completely closed positions and completely open positions, the speed of at least one of the two opening and closing bodies falls due to the effect of a disturbance.

Furthermore, the same processes as those of the first example operation may also be executed in a case where, as two opening and closing bodies out of the D-seat, P-seat, RR-seat, and RL-seat window glasses 36 and the sunroof 38 are being moved from a first intermediate position to a second intermediate position, the speed of at least one of the two opening and closing bodies falls due to the effect of a disturbance.

Second Example Operation

In a second example operation, the plural opening and closing bodies serving as targets are the D-seat and RR-seat window glasses 36 and the sunroof 38. This second example operation is an example in a case where the speed of the D-seat window glass 36 falls due to the effect of a disturbance as the D-seat and RR-seat window glasses 36 and the sunroof 38 are being moved at the same time to a completely open state from a state in which the D-seat, P-seat, RR-seat, and RL-seat window glasses 36 and the sunroof 38 are completely closed.

In this second example operation, the D-seat window glass 36 corresponds to a "first opening and closing body" and the RR-seat window glass 36 and the sunroof 38 correspond to "second opening and closing bodies." Furthermore, in the second example operation, the D-seat motor drive unit 16 corresponds to a "first motor drive unit" and the RR-seat and sunroof motor drive units 16 correspond to "second motor drive units."

Regarding the flow of processes performed by the body ECU 12, reference will be made to FIG. 5, and regarding the flow of processes performed by the D-seat, RR-seat, and sunroof node ECUs 14, reference will be made to FIG. 6.

(Step S1: Target Speed Calculation Step)

The body ECU 12 executes step S1 in a case where it has received, from the master switch 28 for example, an activation command that causes the D-seat and RR-seat window glasses 36 and the sunroof 38 to reach their target open amounts at the same time. In step S1, the CPU 40 (the target speed calculation unit 50) of the body ECU 12 calculates target speeds of each of the D-seat and RR-seat window glasses 36 and the sunroof 38 for reaching the target open amounts at the same time.

In step S1, regarding the D-seat window glass 36, for example, a target speed of 120 mm/s is calculated with respect to a target open amount of 360 mm, and regarding the RR-seat window glass 36, for example, a target speed of 80 mm/s is calculated with respect to a target open amount of 240 mm. Furthermore, regarding the sunroof 38, for example, a target speed of 40 mm/s is calculated with respect to a target open amount of 120 mm.

(Step S2: Activation Command Output Step)

In step S2, the CPU 40 (the activation command output unit 52) of the body ECU 12 outputs the target speed of the D-seat window glass 36 to the D-seat ECU 14, outputs the target speed of the RR-seat window glass 36 to the RR-seat node ECU 14, and outputs the target speed of the sunroof 38 to the sunroof node ECU 14. Next, the CPU 40 (the activation command output unit 52) of the body ECU 12 outputs an open activation command "10" as an activation command to the D-seat, RR-seat, and sunroof node ECUs 14.

(Step S21: Activation Command Determination Step)

In step S21, the CPUs 70 (the activation command determination units 80) of the D-seat, RR-seat, and sunroof node ECUs 14 determine whether or not they have received an activation command from the body ECU 12. The CPUs 70 (the activation command determination units 80) move to step S22 when they determine that they have received an activation command from the body ECU 12.

(Step S22: First Synchronous Control Step)

In step S22, the CPUs 70 (the first synchronous control units 82) of the D-seat and RR-seat node ECUs 14 control the D-seat and RR-seat motor drive units 16 so that the D-seat and RR-seat window glasses 36 move (go down) at the target speeds output from the body ECU 12. Because of this, the D-seat and RR-seat window glasses 36 start moving at the target speeds.

Furthermore, in step S22, the CPU 70 (the first synchronous control unit 82) of the sunroof node ECU 14 controls the sunroof motor drive unit 16 so that the sunroof 38 moves (slides in the opening direction) at the target speed output from the body ECU 12. Because of this, the sunroof 38 starts moving at the target speed.

(Step S23: Activation Status Output Step)

In step S23, the CPUs 70 (the activation status output units 84) of the D-seat, RR-seat, and sunroof node ECUs 14 output open activation statuses "10" as activation statuses to the body ECU 12.

(Step S24: Open Amount Output Step)

In step S24, the CPUs 70 (the open amount output units 86) of the D-seat and RR-seat node ECUs 14 calculate the current open amounts of the D-seat and RR-seat window glasses 36 on the basis of the output of the Hall elements 34 and output the current open amounts they have calculated to the body ECU 12.

Furthermore, in step S24, the CPU 70 (the open amount output unit 86) of the sunroof node ECU 14 calculates the current open amount of the sunroof 38 on the basis of the output of the Hall element 34 and outputs the current open amount it has calculated to the body ECU 12.

(Step S3: Activation Status Determination Step)

In step S3, the CPU 40 (the activation status determination unit 54) of the body ECU 12 determines the activation statuses of the D-seat, RR-seat, and sunroof motor drive units 16 on the basis of the activation statuses output from the D-seat, RR-seat, and sunroof node ECUs 14.

In a case where open activation statuses "10" are being output as the activation statuses from the CPUs 70 of the D-seat, RR-seat, and sunroof node ECUs 14, the CPU 40 (the activation status determination unit 54) of the body ECU 12 determines that the D-seat, RR-seat, and sunroof motor drive units 16 are activated and moves to step S4.

(Step S4: Target Speed Recalculation Step)

In step S4, the CPU 40 (the target speed recalculation unit 56) of the body ECU 12 recalculates the target speeds of each of the D-seat and RR-seat window glasses 36 and the sunroof 38 for reaching the target open amounts at the same time on the basis of the current open amounts of the D-seat and RR-seat window glasses 36 and the sunroof 38.

Here, for example, in a state before a disturbance affects the D-seat window glass 36, the D-seat and RR-seat window glasses 36 and the sunroof 38 are moving at the initial target speeds, so target speeds that are the same as the initial target speeds are recalculated in regard to each of the D-seat and RR-seat window glasses 36 and the sunroof 38.

However, in a state in which the speed of the D-seat window glass 36 has become lower than the initial target speed due to the effect of a disturbance, a target speed that is the same as the initial target speed is recalculated in regard to the D-seat window glass 36, but target speeds that are lower than the initial target speeds are recalculated in regard to each of the RR-seat window glass 36 and the sunroof 38 so that the RR-seat window glass 36 and the sunroof 38 reach their target open amounts at the same time that the D-seat window glass 36 reaches its target open amount.

(Step S5: Target Speed Difference Determination Step)

In step S5, the CPU 40 (the target speed difference determination unit 58) of the body ECU 12 determines whether or not there is a difference between the recalculated target speeds and the initial target speeds in regard to each of the D-seat and RR-seat window glasses 36 and the sunroof 38.

Here, for example, in a state before a disturbance affects the D-seat window glass 36, there are no differences between the recalculated target speeds and the initial target speeds in regard to each of the D-seat and RR-seat window glasses 36 and the sunroof 38, so the CPU 40 (the target speed difference determination unit 58) of the body ECU 12 moves to step S7.

However, for example, in a state in which the speed of the D-seat window glass 36 has become lower than the initial target speed due to the effect of a disturbance, the CPU 40 (the target speed difference determination unit 58) of the body ECU 12 moves to step S6 because there is a difference between the recalculated target speeds and the initial target speeds in regard to the RR-seat window glass 36 and the sunroof 38.

(Step S6: Target Speed Output Step)

In step S6, the CPU 40 (the target speed output unit 60) of the body ECU 12 outputs the recalculated target speeds to the D-seat, RR-seat, and sunroof node ECUs 14.

(Step S25: Target Speed Determination Step)

In step S25, the CPUs 70 (the target speed determination units 88) of the D-seat, RR-seat, and sunroof node ECUs 14 determine whether or not recalculated target speeds have been output from the body ECU 12.

Here, the CPUs 70 (the target speed determination units 88) of the D-seat, RR-seat, and sunroof node ECUs 14 return to step S24 in a case where they have determined that recalculated target speeds have not been output from the body ECU 12. However, the CPUs 70 (the target speed determination units 88) of the D-seat, RR-seat, and sunroof node ECUs 14 move to step S26 in a case where they have determined that recalculated target speeds have been output from the body ECU 12.

(Step S26: Second Synchronous Control Step)

In step S26, the CPUs 70 (the second synchronous control units 90) of the D-seat and RR-seat node ECUs 14 control the motor drive units 16 so that the D-seat and RR-seat window glasses 36 move at the recalculated target speeds. Furthermore, the CPU 70 (the second synchronous control unit 90) of the sunroof node ECU 14 controls the motor drive unit 16 so that the sunroof 38 moves at the recalculated target speed.

Because of this, the D-seat and RR-seat window glasses 36 and the sunroof 38 move at the recalculated target speeds. Namely, the D-seat window glass 36 moves at a target speed that is the same as the initial target speed, but the RR-seat window glass 36 and the sunroof 38 move at target speeds that are lower than the initial target speeds.

Then, the D-seat, RR-seat, and sunroof node ECUs 14 return to step S24 in a case where they have determined that they have not received a stop command from the body ECU 12 in step S27.

In step S24, as mentioned above, the CPUs 70 (the open amount output units 86) of the D-seat and RR-seat node ECUs 14 calculate the current open amounts of the D-seat and RR-seat window glasses 36 on the basis of the output of the Hall elements 34 and output the current open amounts they have calculated to the body ECU 12. Furthermore, the CPU 70 (the open amount output unit 86) of the sunroof node ECU 14 calculates the current open amount of the sunroof 38 on the basis of the output of the Hall element 34 and outputs the current open amount it has calculated to the body ECU 12.

(Step S7: Target Open Amount Reached Determination Step)

In step S7, the CPU 40 (the target open amount reached determination unit 62) of the body ECU 12 determines whether or not each of the D-seat and RR-seat window glasses 36 and the sunroof 38 have reached the target open amounts on the basis of the open amounts output from the D-seat, RR-seat, and sunroof node ECUs 14.

Here, the CPU 40 (the target open amount reached determination unit 62) of the body ECU 12 returns to step S4 in a case where it has determined that each of the D-seat and RR-seat window glasses 36 and the sunroof 38 have not reached the target open amounts. Additionally, the CPU 40 of the body ECU 12 repeatedly executes step S4 to step S7 until it determines that each of the D-seat and RR-seat window glasses 36 and the sunroof 38 have reached the target open amounts.

Because step S4 to step S7 are repeatedly executed, the D-seat and RR-seat window glasses 36 and the sunroof 38 move at the initial target speeds when the effect of the disturbance finally goes away. Then, when the D-seat and RR-seat window glasses 36 and the sunroof 38 reach their target open amounts (completely open positions) at the same time, the CPU 40 (the target open amount reached determination unit 62) of the body ECU 12 determines that each of the D-seat and RR-seat window glasses 36 and the sunroof 38 have reached the target open amounts and moves to step S8.

(Step S8: Stop Command Output Step)

In step S8, the CPU 40 (the stop command output unit 64) of the body ECU 12 outputs a stop command "00" to the D-seat, RR-seat, and sunroof node ECUs 14.

(Step S27: Stop Command Determination Step)

In step S27, the CPUs 70 (the stop command determination units 92) of the D-seat, RR-seat, and sunroof node ECUs 14 determine whether or not they have received a stop command from the body ECU 12. The CPUs 70 (the stop command determination units 92) stop the motor drive units 16 and end the series of processes when they determine that they have received a stop command from the body ECU 12.

In this way, according to the second example operation, when the D-seat and RR-seat window glasses 36 and the sunroof 38 are moving, the target speeds of each of the D-seat and RR-seat window glasses 36 and the sunroof 38 for reaching the target open amounts at the same time are recalculated on the basis of the current open amounts of each of the D-seat and RR-seat window glasses 36 and the sunroof 38. Furthermore, it is determined whether or not there is a difference between the recalculated target speeds and the initial target speeds in regard to the D-seat and RR-seat window glasses 36 and the sunroof 38.

Then, in a case where it has been determined there is a difference between the recalculated target speeds and the initial target speeds in regard to the D-seat and RR-seat window glasses 36 and the sunroof 38, the D-seat, RR-seat, and sunroof motor drive units 16 are controlled so that the D-seat and RR-seat window glasses 36 and the sunroof 38 move at the recalculated target speeds.

Consequently, even in a case where the speed of the D-seat window glass 36 has fallen due to the effect of a disturbance, for example, as the D-seat and RR-seat window glasses 36 and the sunroof 38 are moving, the D-seat and RR-seat window glasses 36 and the sunroof 38 move at the recalculated target speeds so that the D-seat and RR-seat window glasses 36 and the sunroof 38 reach the target open amounts at the same time. Because of this, the D-seat and RR-seat window glasses 36 and the sunroof 38 can be made to reach their target open amounts at the same time.

Furthermore, in a case where the speed of the D-seat window glass 36 is lower than the initial target speed due to the effect of a disturbance, target speeds that are lower than the initial target speeds are recalculated in regard to each of the RR-window glass 36 and the sunroof 38 so that the RR-seat window glass 36 and the sunroof 38 reach their target open amounts at the same time that the D-seat window glass 36 reaches its target open amount.

Consequently, even in a case where the speed of the D-seat window glass 36 has fallen due to the effect of a disturbance, the speeds of the RR-seat window glass 36 and the sunroof 38 are lowered to conform to the D-seat window glass 36, so a situation where the RR-seat window glass 36 and the sunroof 38 reach the target open amounts before the D-seat window glass 36 can be avoided, so that D-seat and RR-seat window glasses 36 and the sunroof 38 can be made to reach their target open amounts at the same time.

It will be noted that the same processes as those of the second example operation may also be executed in a case where, as three opening and closing bodies that are a combination other than the D-seat and RR-seat window glasses 36 and the sunroof 38 out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are completely closed, the speed of at least any of the three opening and closing bodies falls due to the effect of a disturbance.

Furthermore, the same processes as those of the second example operation may also be executed in a case where, as three opening and closing bodies out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are in intermediate positions between completely closed positions and completely open positions, the speed of at least any of the three opening and closing bodies falls due to the effect of a disturbance.

Furthermore, the same processes as those of the second example operation may also be executed in a case where, as three opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are completely open, the speed of at least any of the three opening and closing bodies falls due to the effect of a disturbance.

Furthermore, the same processes as those of the second example operation may also be executed in a case where, as three opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are in intermediate positions between completely closed positions and completely open positions, the speed of at least any of the three opening and closing bodies falls due to the effect of a disturbance.

Furthermore, the same processes as those of the second example operation may also be executed in a case where, as three opening and closing bodies out of the D-seat, P-seat, RR-seat, and RL-seat window glasses 36 and the sunroof 38 are being moved from a first intermediate position to a second intermediate position, the speed of at least any of the three opening and closing bodies falls due to the effect of a disturbance.

Furthermore, the same processes as those of the second example operation may also be executed in the case of causing four opening and closing bodies out of the D-seat, P-seat, RR-seat, and RL-seat window glasses 36 and the sunroof 38 to reach their target open amounts at the same time.

Furthermore, the same processes as those of the second example operation may also be executed in the case of causing the D-seat, P-seat, RR-seat, and RL-seat window glasses 36 and the sunroof 38 to reach their target open amounts at the same time.

Third Example Operation

In a third example operation, step S4 is changed in the following way with respect to the first example operation. That is, in step S4 of the third example operation, in a case where the speed of the D-seat window glass 36 is higher than the initial target speed due to the effect of a disturbance, a target speed that is lower than the initial target speed is recalculated in regard to the D-seat window glass 36 so that the D-seat window glass 36 reaches its target open amount at the same time that the RR-seat window glass 36 reaches its target open amount.

Consequently, even in a case where the speed of the D-seat window glass 36 has risen due to the effect of a disturbance, the speed of the D-seat window glass 36 is lowered to conform to the RR-seat window glass 36, so a situation where the D-seat window glass 36 reaches the target open amount before the RR-seat window glass 36 can be avoided, so that the D-seat and RR-seat window glasses 36 can be made to reach their target open amounts at the same time.

It will be noted that the same processes as those of the third example operation may also be executed in the case of causing two opening and closing bodies that are a combination other than the D-seat and RR-seat window glasses 36 out of the D-seat, P-seat, RR-seat, and RL-seat window glasses 36 and the sunroof 38 to reach their target open amounts at the same time.

Furthermore, the same processes as those of the third example operation may also be executed in the case of causing three or more opening and closing bodies out of the D-seat, P-seat, RR-seat, and RL-seat window glasses 36 and the sunroof 38 to reach their target open amounts at the same time.

Fourth Example Operation

A fourth example operation is an example in a case where at least one of the CPUs 70 of the D-seat and RR-seat node ECUs 14 has not output the open activation status "10" as an activation status even though the CPU 40 of the body ECU 12 has output an activation command.

In a case where at least one of the CPUs 70 of the D-seat and RR-seat node ECUs 14 has not output the open activation status "10" as an activation status in step S23 even though the CPU 40 of the body ECU 12 has output an activation command in step S2, the CPU 40 of the body ECU 12 determines in step S3 that at least one of the D-seat and RR-seat motor drive units 16 is not activated and moves to step S9.

In step S9, the CPU 40 of the body ECU 12 determines whether or not a certain amount of time has elapsed since outputting the activation command in step S2. Here, the CPU 40 of the body ECU 12 returns to step S3 in a case where it has determined that the certain amount of time has not elapsed since outputting the activation command. It will be noted that in step S4, after step S9 has been executed and the CPU 40 of the body ECU 12 has returned to step S3, recalculation of the target speeds is not executed because it is judged that there is an activation abnormality.

However, the CPU 40 of the body ECU 12 moves to step S10 in a case where it has determined that the certain amount of time has elapsed since outputting the activation command.

In step S10, the CPU 40 of the body ECU 12 outputs an abnormality dialog, and in step S11, the CPU 40 of the body ECU 12 outputs a stop command "00" to the node ECU 14 that has not output the open activation status "10" out of the D-seat and RR-seat node ECUs 14. The CPU 70 of the node ECU 14 that has not output the open activation status "10" out of the D-seat and RR-seat node ECUs 14 stops the motor drive unit 16 when it receives the stop command from the body ECU 12.

In this way, in the fourth example operation, in a case where at least one of the CPUs 70 of the D-seat and RR-seat node ECUs 14 has not output the open activation status "10" as an activation status even though the CPU 40 of the body ECU 12 has output the activation command, the motor drive unit 16 connected to the node ECU 14 that has not output the open activation status "10" is stopped.

It will be noted that the same processes as those of the fourth example operation may also be executed in the case of causing two opening and closing bodies that are a combination other than the D-seat and the RR-seat window glasses 36 out of the D-seat, P-seat, RR-seat, and RL-seat window glasses 36 and the sunroof 38 to reach their target open amounts at the same time.

Furthermore, the same processes as those of the fourth example operation may also be executed in the case of causing three or more opening and closing bodies out of the D-seat, P-seat, RR-seat, and RL-seat window glasses 36 and the sunroof 38 to reach their target open amounts at the same time.

Fifth Example Operation

Figure 8:
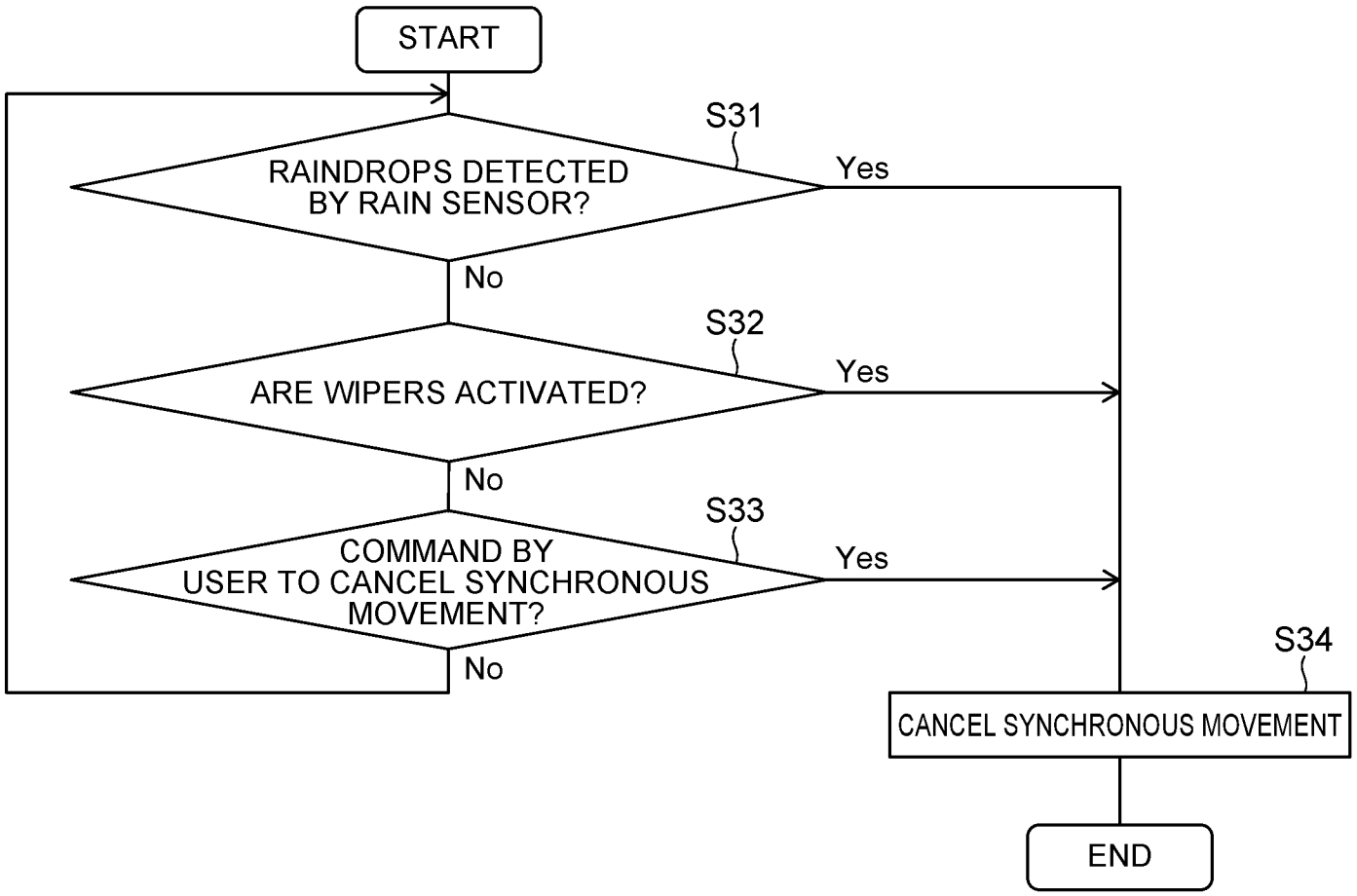
FIG. 8 is a flowchart showing a flow of processes for canceling synchronous movement in the body ECU of FIG. 1.

A fifth example operation is applied in the case of causing two or more opening and closing bodies out of the D-seat, P-seat, RR-seat, and RL-seat window glasses 36 and the sunroof 38 to reach their target open amounts at the same time. This fifth example operation is an example where the CPU 40 of the body ECU 12 cancels synchronous movement in a case where it has been determined that raindrops are detected, or that the wipers are activated, or that a user has instructed cancellation of synchronous movement. "Synchronous movement" corresponds to causing two or more opening and closing bodies to reach their target open amounts at the same time. In FIG. 8, a flow of processes for canceling synchronous movement in the body ECU 12 is shown.

That is, in step S31, the CPU 40 of the body ECU 12 determines whether or not a raindrop detection signal has been output from the rain sensor 18. The CPU 40 of the body ECU 12 moves to step S34 when it determines that a raindrop detection signal has been output from the rain sensor 18.

In step S32, the CPU 40 of the body ECU 12 determines whether or not a wiper activation signal has been output from the wiper ECU 22. The CPU 40 of the body ECU 12 moves to step S34 when it determines that a wiper activation signal has been output from the wiper ECU 22.

The meter 24 outputs a cancel signal when the vehicle speed exceeds a prescribed speed, and the steering switch 26 outputs a cancel signal in response to operation by the user. In step S33, the CPU 40 of the body ECU 12 determines whether or not a cancel signal has been output from the meter 24 or the steering switch 26. The CPU 40 of the body ECU 12 moves to step S34 when it determines that a cancel signal has been output from the meter 24 or the steering switch 26.

In step S34, the body ECU 12 cancels the synchronous movement. That is, the processes for causing two or more opening and closing bodies out of the D-seat, P-seat, RR-seat, and RL-seat window glasses 36 and the sunroof 38 to reach their target open amounts at the same time is terminated.

Second Embodiment

Next, a second embodiment of the invention will be described.

Figure 9:
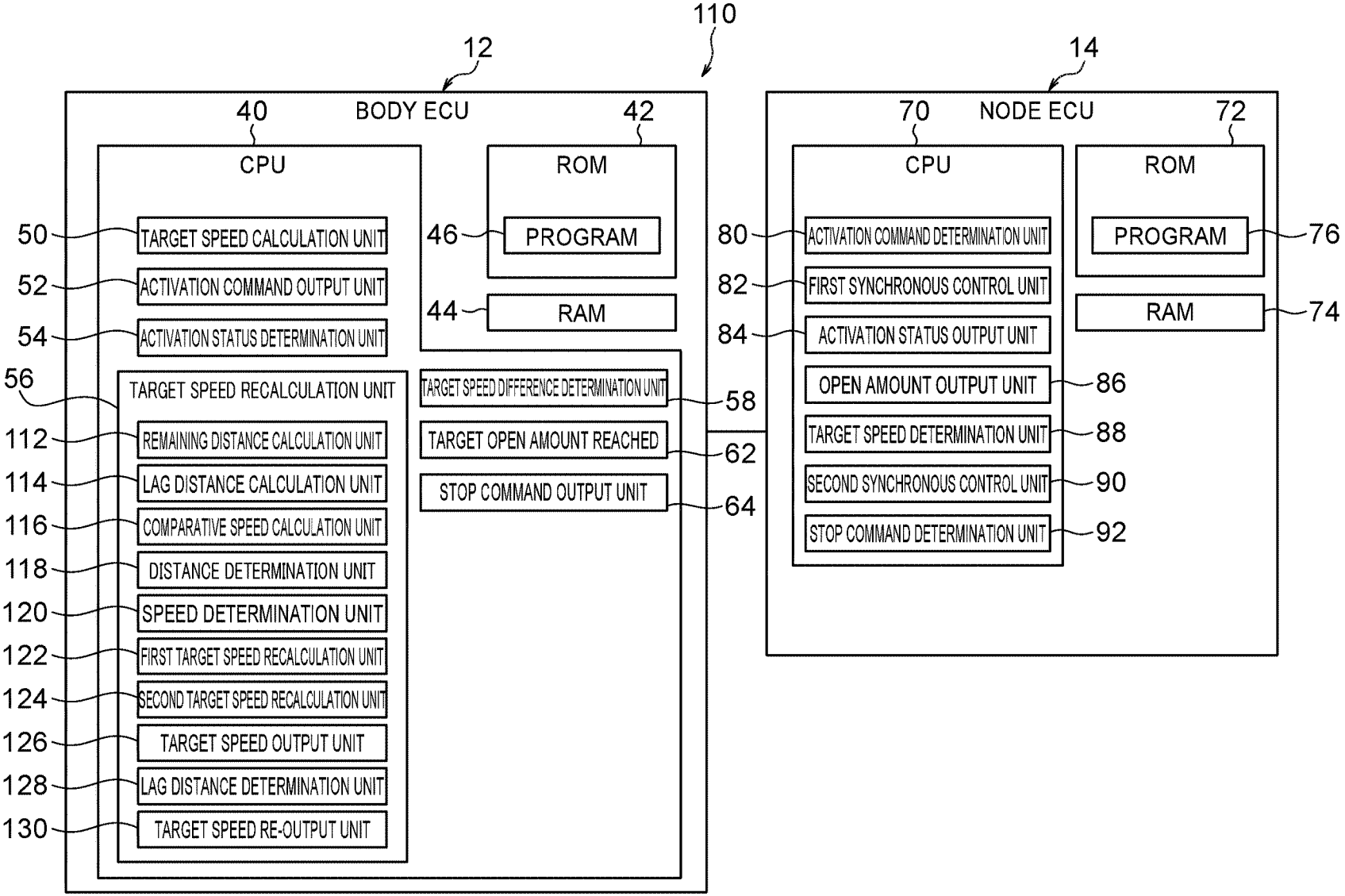
FIG. 9 is a block diagram of an opening and closing body control device pertaining to a second embodiment.

In FIG. 9, an opening and closing body control device 110 pertaining to the second embodiment is shown in a block diagram. In the second embodiment, the configuration of the program 46 is changed, and the configuration of the target speed recalculation unit 56 is changed in the following way as a result of the program 46 being changed, with respect to the first embodiment.

That is, the target speed recalculation unit 56 has a remaining distance calculation unit 112, a lag distance calculation unit 114, a comparative speed calculation unit 116, a distance determination unit 118, a speed determination unit 120, a first target speed recalculation unit 122, a second target speed recalculation unit 124, a target speed output unit 126, a lag distance determination unit 128, and a target speed re-output unit 130. The residual distance calculation unit 112 and so forth are realized by the CPU 40 executing the program 46.

Next, an example operation of the opening and closing body control device 110 pertaining to the second embodiment will be described.

In this example operation, the plural opening and closing bodies serving as targets are the D-seat and RR-seat window glasses 36. This example operation is an example in a case where the speed of the D-seat window glass 36 falls due to the effect of a disturbance as the D-seat and RR-seat window glasses 36 are being moved at the same time to a completely open state from a state in which the D-seat, P-seat, RR-seat, and RL-seat window glasses 36 and the sunroof 38 are completely closed.

In this example operation, the D-seat window glass 36 corresponds to a "first opening and closing body" and the RR-seat window glass 36 corresponds to a "second opening and closing body." Furthermore, in the second example operation, the D-seat motor drive unit 16 corresponds to a "first motor drive unit" and the RR-seat motor drive unit 16 corresponds to a "second motor drive unit."

Figure 10:
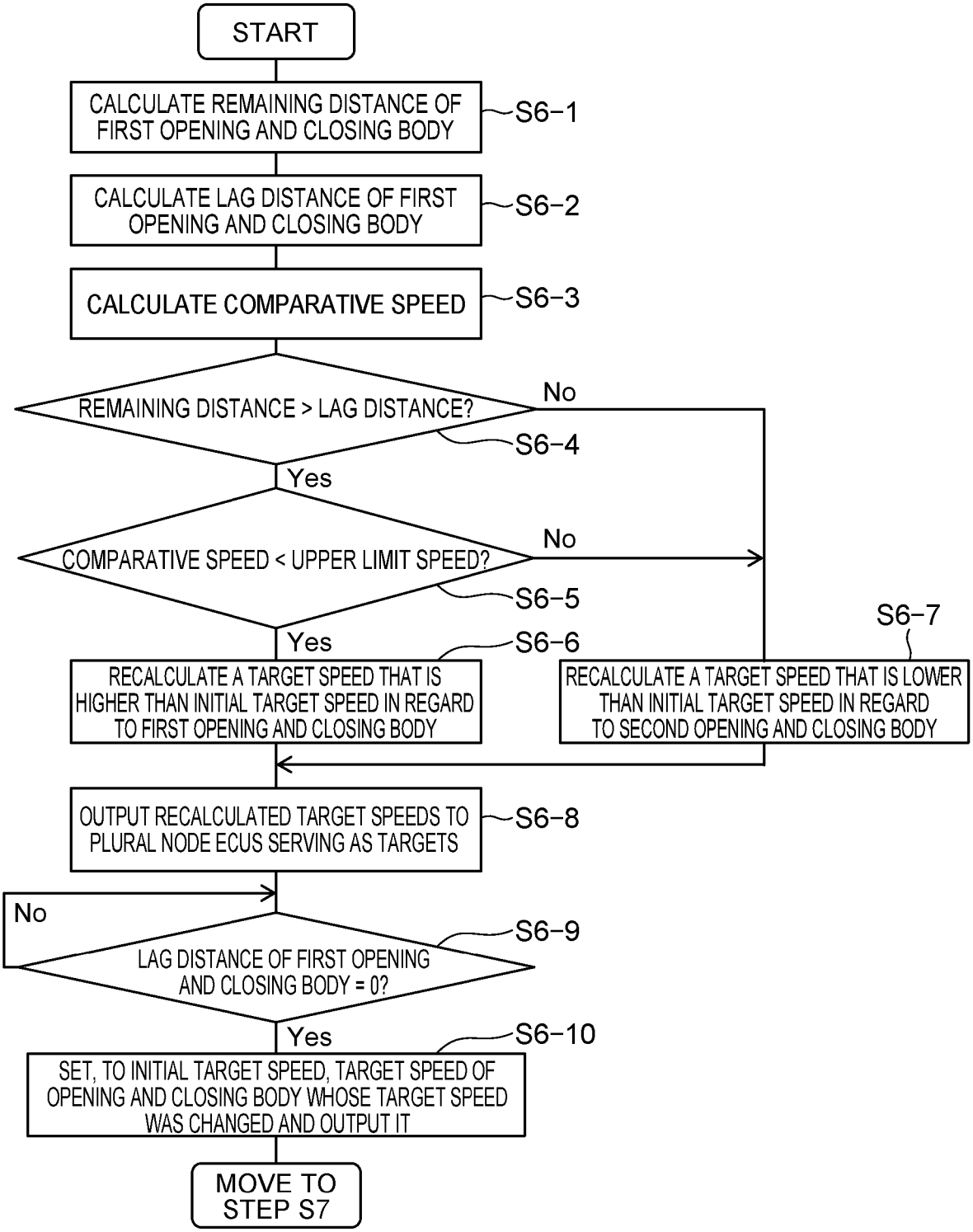
FIG. 10 is a flowchart showing a flow of processes performed by a target speed recalculation unit of FIG. 9.

Regarding the flow of processes performed by the body ECU 12, reference will be made to FIG. 5, and regarding the flow of processes performed by the D-seat and RR-seat node ECUs 14, reference will be made to FIG. 6. In FIG. 10, a flow of processes performed by the target speed recalculation unit 56 in the second embodiment is shown, and in FIG. 11, a timing chart of signals transmitted and received between the body ECU 12 and the D-seat and RR-seat node ECUs 14 in the second embodiment is shown.

Figure 5:
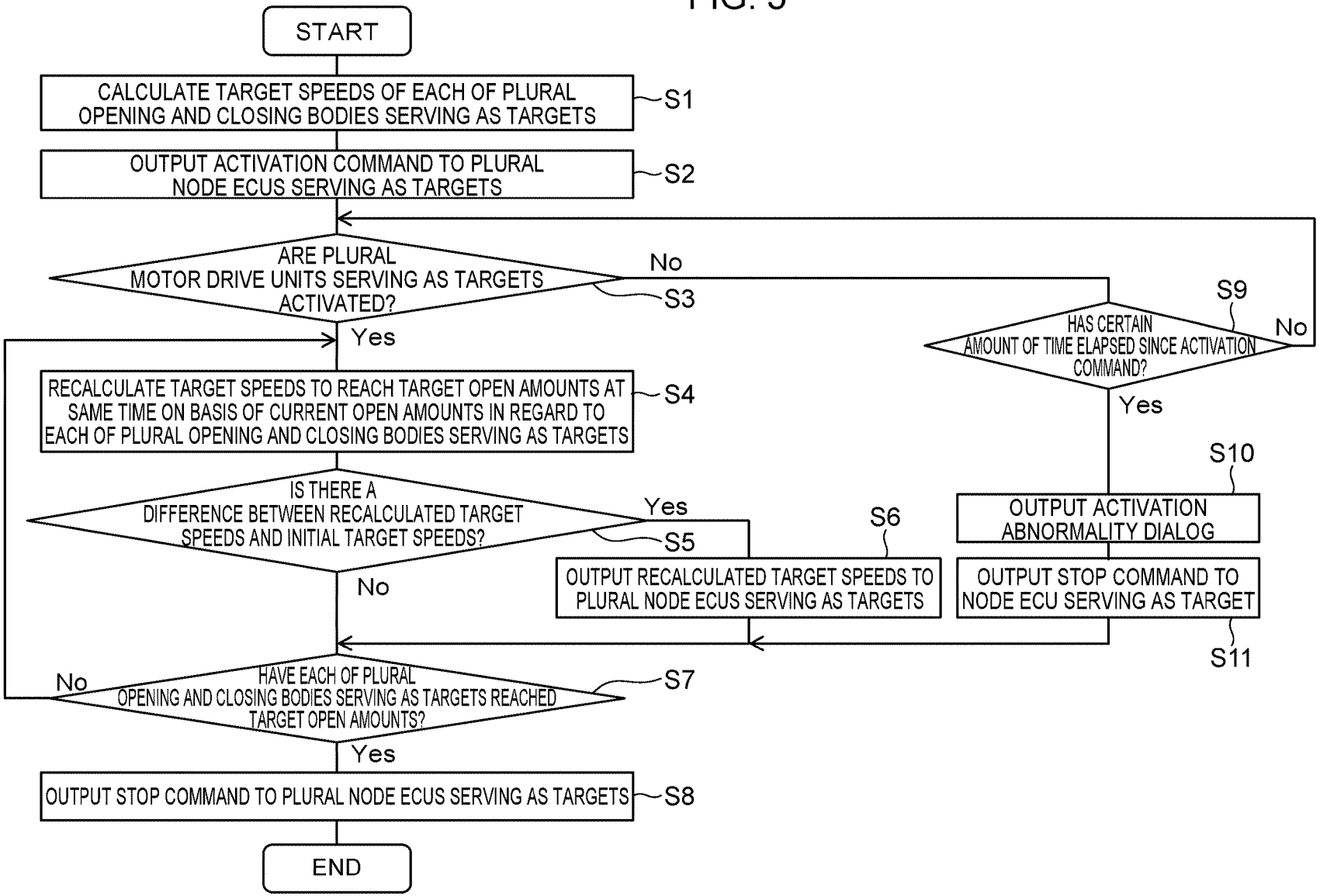
FIG. 5 is a flowchart showing a flow of processes performed by the body ECU of FIG. 1.

In the second embodiment, step S6-1 to step S6-10 of FIG. 10 are executed instead of step S6 of FIG. 5 with respect to the first embodiment. That is, step S6-1 to step S6-10 of FIG. 10 are executed in a case where it has been determined in step S5 of FIG. 5 by the target speed difference determination unit 58 that there is a difference between the target speeds recalculated in step S4 and the initial target speeds.

In this example operation, the RR-seat window glass 36 moves at the initial target speed, but the speed of the D-seat window glass 36 becomes lower than the initial target speed due to the effect of a disturbance, so step S6-1 to step S6-10 of FIG. 10 are executed.

(Step S6-1: Remaining Distance Calculation Step)

In step S6-1, the CPU 40 (the remaining distance calculation unit 112) of the body ECU 12 calculates a remaining distance until the D-seat window glass 36 reaches its target open amount. The remaining distance is calculated by the difference between the target open amount and the current open amount.

(Step S6-2: Lag Distance Calculation Step)

In step S6-2, the CPU 40 (the lag distance calculation unit 114) of the body ECU 12 calculates a lag distance of the D-seat window glass 36. The lag distance is calculated by the difference between the open amount of the D-seat window glass 36 in a case supposing that the D-seat window glass 36 had been moving at the initial target speed and the current open amount of the D-seat window glass 36.

(Step S6-3: Comparative Speed Calculation Step)

In step S6-3, the CPU 40 (the comparative speed calculation unit 116) of the body ECU 12 calculates a comparative speed. The comparative speed is calculated by dividing the remaining distance by the time until the RR-seat window glass 36 reaches its target open amount.

(Step S6-4: Distance Determination Step)

In step S6-4, the CPU 40 (the distance determination unit 118) of the body ECU 12 determines whether or not the remaining distance is longer than the lag distance. Here, the CPU 40 (the distance determination unit 118) of the body ECU 12 moves to step S6-S in a case where it has determined that the remaining distance is longer than the lag distance and moves to step S6-7 in a case where it has determined that the remaining distance is equal to or less than the lag distance.

(Step S6-5: Speed Determination Step)

In step S6-5, the CPU 40 (the speed determination unit 120) of the body ECU 12 determines whether or not an upper limit speed that has been set beforehand in regard to the D-seat window glass 36 is higher than the comparative speed. Here, the CPU 40 (the speed determination unit 120) of the body ECU 12 moves to step S6-6 in a case where it has determined that the upper limit speed is higher than the comparative speed and moves to step S6-7 in a case where it has determined that the upper limit speed is equal to or less than the comparative speed.

(Step S6-6: First Target Speed Recalculation Step)

In step S6-6, the CPU 40 (the first target speed recalculation unit 122) of the body ECU 12 recalculates a target speed that is higher than the initial target speed in regard to the D-seat window glass 36.

(Step S6-7: Second Target Speed Recalculation Step)

In step S6-7, the CPU 40 (the second target speed recalculation unit 124) of the body ECU 12 recalculates a target speed that is lower than the initial target speed in regard to the RR-seat window glass 36.

(Step S6-8: Target Speed Output Step)

In step S6-8, the CPU 40 (the target speed output unit 126) of the body ECU 12 outputs the recalculated target speeds to the D-seat and RR-seat node ECUs 14.

At this time, in a case where the remaining distance of the D-seat window glass 36 is longer than the lag distance and the upper limit speed of the D-seat window glass 36 is higher than the comparative speed, the target speed recalculated in step S6-6 in regard to the D-seat window glass 36 is output to the D-seat node ECU 14. Furthermore, regarding the RR-seat window glass 36, the target speed recalculated in step S4 (a target speed that is the same as the initial target speed) is output to the RR-seat node ECU 14.

However, in a case where the remaining distance of the D-seat window glass 36 is equal to or less than the lag distance or a case where the upper limit speed of the D-seat window glass 36 is equal to or less than the comparative speed, the target speed recalculated in step S6-7 in regard to the RR-seat window glass 36 is output to the RR-seat node ECU 14. Furthermore, regarding the D-seat window glass 36, a target speed that is the same as the initial target speed is output as the recalculated target speed to the D-seat node ECU 14.

(Step S25: Target Speed Determination Step)

In step S25, the CPUs 70 (the target speed determination units 88) of the D-seat and RR-seat node ECUs 14 determine whether or not recalculated target speeds have been output from the body ECU 12. The CPUs 70 (the target speed determination units 88) of the D-seat and RR-seat node ECUs 14 move to step S26 in a case where they have determined that recalculated target speeds have been output from the body ECU 12.

(Step S26: Second Synchronous Control Step)

In step S26, the CPUs 70 (the second synchronous control units 90) of the D-seat and RR-seat node ECUs 14 control the motor drive units 16 so that the D-seat and RR-seat window glasses 36 move at the recalculated target speeds. Because of this, each of the D-seat and RR-seat window glasses 36 move at the recalculated target speeds.

Namely, in this example operation, in a case where the remaining distance of the D-seat window glass 36 is longer than the lag distance and the upper limit speed of the D-seat window glass 36 is higher than the comparative speed, the RR-seat window glass 36 moves at a target speed that is the same as the initial target speed, but the D-seat window glass 36 moves at a target speed that is higher than the initial target speed.

However, in this example operation, in a case where the remaining distance of the D-seat window glass 36 is equal to or less than the lag distance or a case where the upper limit speed of the D-seat window glass 36 is equal to or less than the comparative speed, the D-seat window glass 36 moves at a target speed that is the same as the initial target speed, but the RR-seat window glass 36 moves at a target speed that is lower than the initial target speed.

Then, the D-seat and RR-seat node ECUs 14 return to step S24 in a case where they have determined that they have not received a stop command from the body ECU 12 in step S27. In step S24, as mentioned above, the CPUs 70 (the open amount output units 86) of the D-seat and RR-seat node ECUs 14 calculate the current open amounts of the D-seat and RR-seat window glasses 36 on the basis of the output of the Hall elements 34 and output the current open amounts they have calculated to the body ECU 21.

(Step S6-9: Lag Distance Determination Step)

In step S6-9, the CPU 40 (the lag distance determination unit 128) of the body ECU 12 determines whether or not the lag distance of the D-seat window glass 36 has become zero. The CPU 40 (the lag distance determination unit 128) of the body ECU 12 repeatedly executes step S6-9 until the lag distance of the D-seat window glass 36 becomes zero. Then, the CPU 40 (the lag distance determination unit 128) of the body ECU 12 moves to step S6-10 in a case where it has determined that the lag distance of the D-seat window glass 36 has become zero.

(Step S6-10: Target Speed Re-output Step)

In step S6-10, the CPU 40 (the target speed re-output unit 130) of the body ECU 12 sets, to the initial target speed, the target speed of the window glass whose target speed was changed out of the D-seat and RR-seat window glasses 36. Then, the CPU 40 outputs the initial target speed as a recalculated target speed to the node ECU 14 of the window glass whose target speed was changed out of the D-seat and RR-seat window glasses 36. Because of this, the window glass whose target speed was changed out of the D-seat and RR-seat window glasses 36 moves at the recalculated target speed (the initial target speed).

Then, the CPU 40 of the body ECU 12 moves to step S7 and executes step S4 to step S7 until each of the D-seat and RR-seat window glasses 36 reach the target open amounts.

In this way, according to the second embodiment, in a case where the remaining distance until reaching the target open amount of the D-seat window glass 36 is longer than the lag distance of the D-seat window glass 36 and the upper limit speed of the D-seat window glass 36 is higher than the comparative speed, a target speed that is higher than the initial target speed is recalculated in regard to the D-seat window glass 36.

Figure 11:
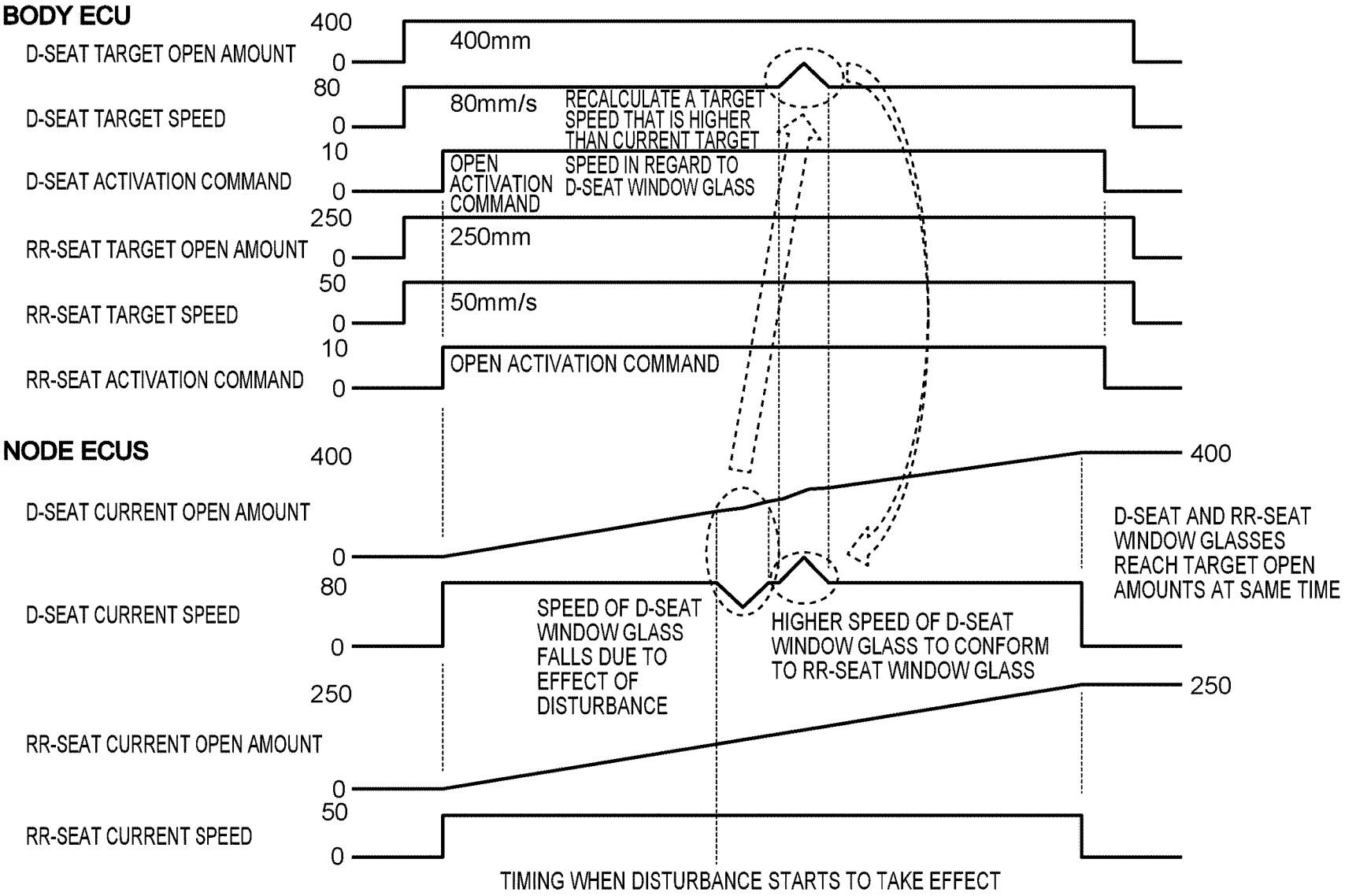
FIG. 11 is a timing chart showing an example of signals transmitted and received between the body ECU and the node ECUs of FIG. 9.

Consequently, for example, as shown in FIG. 11, even in a case where the speed of the D-seat window glass 36 has fallen due to the effect of a disturbance, the speed of the D-seat window glass 36 is raised to conform to the RR-seat window glass 36, so a situation where the RR-seat window glass 36 reaches the target open amount before the D-seat window glass 36 can be avoided, so that the D-seat window glass 36 and the RR-seat window glass 36 can be made to reach their target open amounts at the same time.

However, in a case where the remaining distance until reaching the target open amount of the RR-seat window glass 36 is equal to or less than the lag distance of the D-seat window glass 36 or the upper limit speed of the D-seat window glass 36 is equal to or less than the comparative speed, a target speed that is lower than the initial target speed is recalculated in regard to the RR-seat window glass 36.

Consequently, in a case where the RR-seat window glass 36 will end up reaching the target open amount first even if the speed of the D-seat window glass 36 is raised, the speed of the RR-seat window glass 36 is lowered to conform to the D-seat window glass 36, so a situation where the RR-seat window glass 36 reaches the target open amount before the D-seat window glass 36 can be avoided, so that the D-seat window glass 36 and the RR-seat window glass 36 can be made to reach their target open amounts at the same time.

It will be noted that the same processes as those of the second embodiment may also be executed in a case where, as two or more opening and closing bodies that are a combination other than the D-seat and RR-seat window glasses 36 out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are completely closed, the speed of at least any of the two or more opening and closing bodies falls due to the effect of a disturbance.

Furthermore, the same processes as those of the second embodiment may also be executed in a case where, as two or more opening and closing bodies out of the D-seat, P-seat, RR-seat, and RL-seat window glasses 36 and the sunroof 38 are being moved at the same time to a completely open state from a state in which the D-seat, P-seat, RR-seat, and RL-seat window glasses 36 and the sunroof 38 are in intermediate positions between completely closed positions and completely open positions, the speed of at least any of the two or more opening and closing bodies falls due to the effect of a disturbance.

Furthermore, the same processes as those of the second embodiment may also be executed in a case where, as two or more opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are completely open, the speed of at least any of the two or more opening and closing bodies falls due to the effect of a disturbance.

Furthermore, the same processes as those of the second embodiment may also be executed in a case where, as two or more opening and closing bodies out of the D-seat, P-seat, RR-seat, and RL-seat window glasses 36 and the sunroof 38 are being moved at the same time to a completely closed state from a state in which the D-seat, P-seat, RR-seat, and RL-seat window glasses 36 and the sunroof 38 are in intermediate positions between completely closed positions and completely open positions, the speed of at least any of the two or more opening and closing bodies falls due to the effect of a disturbance.

Furthermore, the same processes as those of the second embodiment may also be executed in a case where, as two opening and closing bodies out of the D-seat, P-seat, RR-seat, and RL-seat window glasses 36 and the sunroof 38 are being moved from a first intermediate position to a second intermediate position, the speed of at least one of the two opening and closing bodies falls due to the effect of a disturbance.

Next, example modifications common to the first and second embodiments will be described.

In the above embodiments, the opening and closing body control devices 10, 110 are applied to a vehicle in which the D-seat, P-seat, RR-seat, and RL-seat window glasses 36 and the sunroof 38 open and close, but they may also be applied to a vehicle in which only the D-seat and P-seat window glasses 36 and the sunroof 38 open and close, and may also be applied to a vehicle in which only the D-seat and P-seat window glasses 36 open and close.

Furthermore, in the above embodiments, the opening and closing bodies that the opening and closing body control devices 10, 110 control are the window glasses 36 and the sunroof 38, but they may also be opening and closing bodies of a vehicle other than the window glasses 36 and the sunroof 38.

Furthermore, in the above embodiments, the opening and closing body control devices 10, 110 control the window glasses 36 and the sunroof 38 that have a sliding configuration, but the opening and closing bodies that the opening and closing body control devices 10, 110 control may also have a swinging configuration.

Furthermore, in the above embodiments, the D-seat and P-seat window glasses 36, the RR-seat and RL-seat window glasses 36, and the sunroof 38 have mutually different total stroke amounts, but the total stroke amounts of the plural opening and closing bodies that the opening and closing body control devices 10, 110 control may also be the same.

Furthermore, in the above embodiments, the body ECU 12 and the node ECUs 14 that are separate control units are used to control the window glasses 36 and the sunroof 38, but a control unit in which the functions of the body ECU 12 and the node ECUs 14 are integrated may also be used.

Furthermore, in the above embodiments, the opening and closing body control devices 10, 110 are applied to a vehicle such as a passenger car, but they may also be applied to something other than a vehicle such as a passenger car.

Furthermore, in the above embodiments, the functional units such as the target speed calculation unit 50 in the body ECU 12 are realized by the CPU 40 executing the program 46. However, the functional units such as the target speed calculation unit 50 may also be realized by programmable logic devices (PLDs) whose circuit configuration can be changed after manufacture, such as field-programmable gate arrays (FPGAs), for example, and may also be realized by dedicated electrical circuits dedicatedly designed for executing specific processes, such as application-specific integrated circuits (ASICs), for example.

Similarly, in the above embodiments, the functional units such as the activation command determination units 80 in the node ECUs 14 are realized by the CPUs 70 executing the programs 76. However, the functional units such as the activation command determination units 80 may also be realized by PLDs such as FPGAs, for example, and may also be realized by dedicated electrical circuits such as ASICs, for example.

First and second embodiments of the invention have been described above, but the present invention is not limited to what is described above and can of course be modified and implemented in various ways, in addition to what is described above, in a range that does not depart from the spirit thereof.

What is claimed is:

1. An opening and closing body control device, comprising:

a first motor drive unit that causes a first opening and closing body to move in opening and closing directions;

a second motor drive unit that causes a second opening and closing body to move in opening and closing directions;

a target speed calculation unit that, in a case in which an activation command that causes the first opening and closing body and the second opening and closing body to reach respective target open amounts at the same time has been received, calculates respective target speeds of each of the first opening and closing body and the second opening and closing body for reaching the target open amounts at the same time;

a first synchronous control unit that controls the first motor drive unit and the second motor drive unit so that the first opening and closing body and the second opening and closing body move at the respective target speeds;

a target speed recalculation unit that, when the first opening and closing body and the second opening and closing body are moving, recalculates the respective target speeds of each of the first opening and closing body and the second opening and closing body for reaching the target open amounts at the same time; and a second synchronous control unit that, in a case in which a speed of at least one of the first opening and closing body or the second opening and closing body is different from the target speed calculated by the target speed calculation unit, controls the first motor drive unit and the second motor drive unit so that the first opening and closing body and the second opening and closing body move at the respective target speeds recalculated by the target speed recalculation unit.

2. The opening and closing body control device according to claim 1, wherein the target speed recalculation unit, in a case in which the second opening and closing body is moving at the respective target speed calculated by the target speed calculation unit and the speed of the first opening and closing body is lower than the respective target speed calculated by the target speed calculation unit, recalculates a target speed that is lower than the respective target speed calculated by the target speed calculation unit with regard to the second opening and closing body so that the second opening and closing body reaches its target open amount at the same time that the first opening and closing body reaches its target open amount.

3. The opening and closing body control device according to claim 1, wherein the target speed recalculation unit, in a case in which the second opening and closing body is moving at the respective target speed calculated by the target speed calculation unit and the speed of the first opening and closing body is higher than the respective target speed calculated by the target speed calculation unit, recalculates a target speed that is lower than the respective target speed calculated by the target speed calculation unit with regard to the first opening and closing body so that the first opening and closing body reaches its target open amount at the same time that the second opening and closing body reaches its target open amount.

4. The opening and closing body control device according to claim 1, wherein the target speed recalculation unit comprises:

a remaining distance calculation unit that, in a case in which the second opening and closing body is moving at the respective target speed calculated by the target speed calculation unit and the speed of the first opening and closing body is lower than the respective target speed calculated by the target speed calculation unit, calculates a remaining distance until the first opening and closing body reaches its target open amount, a lag distance calculation unit that calculates a lag distance that is a difference between an open amount of the first opening and closing body in a case in which it is presumed that that the first opening and closing body had been moving at the respective target speed calculated by the target speed calculation unit and a current open amount of the first opening and closing body, a comparative speed calculation unit that calculates a comparative speed obtained by dividing the remaining distance by a time until the second opening and closing body reaches its target open amount, a distance determination unit that determines whether or not the remaining distance is longer than the lag distance, a speed determination unit which, in a case in which it has been determined by the distance determination unit that the remaining distance is longer than the lag distance, determines whether or not an upper limit speed that has been set beforehand with regard to the first opening and closing body is higher than the comparative speed, and a first target speed recalculation unit that, in a case in which it has been determined by the speed determination unit that the upper limit speed is higher than the comparative speed, recalculates a target speed that is higher than the respective target speed calculated by the target speed calculation unit with regard to the first opening and closing body.

5. The opening and closing body control device according to claim 4, wherein the target speed recalculation unit further comprises a second target speed recalculation unit which, in a case in which it has been determined by the distance determination unit that the remaining distance is equal to or less than the lag distance or in a case in which it has been determined by the speed determination unit that the upper limit speed is equal to or less than the comparative speed, recalculates a target speed that is lower than the target speed calculated by the target speed calculation unit with regard to the second opening and closing body.

* * * * *